US011213062B2

(12) United States Patent
Reinbold et al.

(10) Patent No.: US 11,213,062 B2
(45) Date of Patent: Jan. 4, 2022

(54) STABILIZER FOR MOIST SNUFF

(71) Applicant: American Snuff Company, LLC, Memphis, TN (US)

(72) Inventors: Robert Reinbold, Collierville, TN (US); John E. Bunch, Cary, NC (US)

(73) Assignee: American Snuff Company, Memphis, TN (US)

( * ) Notice: Subject to any disclaimer, the term of this patent is extended or adjusted under 35 U.S.C. 154(b) by 292 days.

(21) Appl. No.: 16/407,619

(22) Filed: May 9, 2019

(65) Prior Publication Data

US 2020/0352214 A1 Nov. 12, 2020

(51) Int. Cl.
*A24B 15/30* (2006.01)

(52) U.S. Cl.
CPC ..... *A24B 15/301* (2013.01)

(58) Field of Classification Search
None
See application file for complete search history.

(56) References Cited

U.S. PATENT DOCUMENTS

| | | | |
|---|---|---|---|
| 1,376,586 | A | 5/1921 | Schwartz |
| 3,696,917 | A | 10/1972 | Levi |
| 4,148,325 | A | 4/1979 | Solomon et al. |
| 4,340,073 | A | 7/1982 | de la Burde et al. |
| 4,343,317 | A | 8/1982 | Bokelman |
| 4,347,859 | A | 9/1982 | Bokelman et al. |
| 4,513,756 | A | 4/1985 | Pittman et al. |
| 4,528,993 | A | 7/1985 | Sensabaugh, Jr. et al. |
| 4,607,479 | A | 8/1986 | Linden |
| 4,624,269 | A | 11/1986 | Story et al. |
| 4,631,899 | A | 12/1986 | Nielsen |
| 4,660,577 | A | 4/1987 | Sensabaugh et al. |
| 4,987,907 | A | 1/1991 | Townend |
| 4,991,599 | A | 2/1991 | Tibbetts |
| 5,092,352 | A | 3/1992 | Sprinkle, III et al. |

(Continued)

FOREIGN PATENT DOCUMENTS

| | | |
|---|---|---|
| CN | 107095116 | 4/2017 |
| EP | 3192380 | 7/2017 |

(Continued)

OTHER PUBLICATIONS

Adlkofer, F. In *Effects of Nicotine on Biological Systems II*, Clarke, P. et al. (Eds.); 1998, pp. 17-25).

(Continued)

*Primary Examiner* — Dennis R Cordray

(57) ABSTRACT

The disclosure provides a method for improving the storage stability of a moist smokeless tobacco product configured for oral use, for example, a moist snuff tobacco product. The moist smokeless tobacco product includes a tobacco formulation containing a tobacco material. The method includes mixing the tobacco material with one or more antioxidants and one or more preservatives to form the tobacco formulation. The disclosure also provides a moist smokeless tobacco product incorporating a tobacco material and one or more antioxidants and one or more preservatives. Such moist smokeless tobacco products exhibit improved storage stability with respect to one or more characteristics such as nitrite, tobacco specific nitrosamine, organic acid, pH, and moisture content.

26 Claims, 14 Drawing Sheets

(56) References Cited

U.S. PATENT DOCUMENTS

| | | | |
|---|---|---|---|
| 5,167,244 | A | 12/1992 | Kjerstad |
| 5,259,403 | A | 11/1993 | Guy et al. |
| 5,346,734 | A | 9/1994 | Wydick |
| 5,387,416 | A | 2/1995 | White et al. |
| 5,539,093 | A | 7/1996 | Fitzmaurice et al. |
| 5,668,295 | A | 9/1997 | Wahab et al. |
| 5,705,624 | A | 1/1998 | Fitzmaurice et al. |
| 5,803,081 | A | 9/1998 | O'Donnell, Jr. et al. |
| 5,844,119 | A | 12/1998 | Weigel |
| 5,908,032 | A | 6/1999 | Poindexter et al. |
| 6,162,516 | A | 12/2000 | Derr |
| 6,202,649 | B1 | 3/2001 | Williams |
| 6,510,855 | B1 | 1/2003 | Korte et al. |
| 6,668,839 | B2 | 12/2003 | Williams |
| 6,730,832 | B1 | 5/2004 | Dominguez et al. |
| 6,805,134 | B2 | 10/2004 | Peele |
| 6,834,654 | B2 | 12/2004 | Williams |
| 6,887,307 | B1 | 5/2005 | Scott et al. |
| 6,895,974 | B2 | 5/2005 | Peele |
| 6,923,981 | B2 | 8/2005 | Leung et al. |
| 6,953,040 | B2 | 10/2005 | Atchley et al. |
| 7,014,039 | B2 | 3/2006 | Henson et al. |
| 7,025,066 | B2 | 4/2006 | Lawson et al. |
| 7,032,601 | B2 | 4/2006 | Atchley et al. |
| 7,173,170 | B2 | 2/2007 | Liu et al. |
| 7,208,659 | B2 | 4/2007 | Colliver et al. |
| 7,230,160 | B2 | 6/2007 | Benning et al. |
| 7,293,564 | B2 | 11/2007 | Perfetti et al. |
| 7,404,406 | B2 | 7/2008 | Peele |
| D592,956 | S | 5/2009 | Thiellier |
| 7,537,110 | B2 | 5/2009 | Kutsch et al. |
| D594,154 | S | 6/2009 | Patel et al. |
| 7,549,425 | B2 | 6/2009 | Koga et al. |
| 7,556,047 | B2 | 7/2009 | Poindexter et al. |
| 7,584,843 | B2 | 9/2009 | Kutsch et al. |
| 7,650,892 | B1 | 1/2010 | Groves et al. |
| 7,694,686 | B2 | 4/2010 | Atchley et al. |
| 7,798,153 | B2 | 9/2010 | Lawrence, Jr. |
| D625,178 | S | 10/2010 | Bailey et al. |
| 7,861,728 | B2 | 1/2011 | Holton, Jr. et al. |
| 8,061,362 | B2 | 11/2011 | Mua et al. |
| 8,186,360 | B2 | 5/2012 | Marshall et al. |
| 8,353,300 | B2 | 1/2013 | Li et al. |
| 8,397,945 | B2 | 3/2013 | Gelardi et al. |
| 8,434,496 | B2 | 5/2013 | Chen et al. |
| 8,944,072 | B2 | 2/2015 | Chen et al. |
| 8,991,403 | B2 | 3/2015 | Chen et al. |
| 9,066,538 | B2 | 3/2015 | Chen et al. |
| 9,155,334 | B2 | 10/2015 | Moldoveanu et al. |
| 9,237,769 | B2 | 1/2016 | Mua et al. |
| 2004/0020503 | A1 | 2/2004 | Williams |
| 2004/0118422 | A1 | 6/2004 | Lundin et al. |
| 2005/0061339 | A1 | 3/2005 | Hansson et al. |
| 2005/0115580 | A1 | 6/2005 | Quinter et al. |
| 2005/0244521 | A1 | 11/2005 | Strickland et al. |
| 2006/0191548 | A1 | 8/2006 | Strickland et al. |
| 2006/0236434 | A1 | 10/2006 | Conkling et al. |
| 2007/0062549 | A1 | 3/2007 | Holton, Jr. et al. |
| 2007/0186941 | A1 | 8/2007 | Holton, Jr. et al. |
| 2007/0186942 | A1 | 8/2007 | Strickland et al. |
| 2008/0029110 | A1 | 2/2008 | Dube et al. |
| 2008/0029116 | A1 | 2/2008 | Robinson et al. |
| 2008/0173317 | A1 | 7/2008 | Robinson et al. |
| 2008/0196730 | A1 | 8/2008 | Engstrom et al. |
| 2008/0209586 | A1 | 8/2008 | Nielsen et al. |
| 2008/0305216 | A1 | 12/2008 | Crawford et al. |
| 2009/0014343 | A1 | 1/2009 | Clark et al. |
| 2009/0014450 | A1 | 1/2009 | Bjorkholm |
| 2009/0065013 | A1 | 3/2009 | Essen et al. |
| 2009/0223989 | A1 | 9/2009 | Gelardi |
| 2009/0230003 | A1 | 9/2009 | Thiellier |
| 2009/0250360 | A1 | 10/2009 | Bellamah et al. |
| 2009/0266837 | A1 | 10/2009 | Gelardi et al. |
| 2009/0293889 | A1 | 12/2009 | Kumar et al. |
| 2010/0084424 | A1 | 4/2010 | Gelardi |
| 2010/0133140 | A1 | 6/2010 | Bailey et al. |
| 2010/0264157 | A1 | 10/2010 | Bailey et al. |
| 2010/0291245 | A1 | 11/2010 | Gao et al. |
| 2011/0083688 | A1* | 4/2011 | Mishra ..... A24B 13/00 131/352 |
| 2011/0104218 | A1 | 5/2011 | Karles et al. |
| 2011/0139164 | A1 | 6/2011 | Mua et al. |
| 2011/0168712 | A1 | 7/2011 | Bailey et al. |
| 2011/0204074 | A1 | 8/2011 | Gelardi et al. |
| 2011/0236442 | A1 | 9/2011 | Miser et al. |
| 2013/0186419 | A1* | 7/2013 | Gao ..... A24B 13/00 131/275 |
| 2013/0269719 | A1 | 10/2013 | Marshall et al. |
| 2018/0289054 | A1 | 10/2018 | Gerardi et al. |

FOREIGN PATENT DOCUMENTS

| | | |
|---|---|---|
| WO | 83/01180 | 4/1983 |
| WO | 98/05226 | 2/1998 |
| WO | 98/58555 | 12/1998 |
| WO | 01/35770 | 5/2001 |
| WO | 02/13636 | 2/2002 |
| WO | 03/094639 | 11/2003 |
| WO | 04/095959 | 11/2004 |
| WO | 05/041699 | 5/2005 |
| WO | 05/063060 | 7/2005 |
| WO | 08/103935 | 8/2008 |
| WO | 10/132444 | 11/2010 |

OTHER PUBLICATIONS

Andersen, R. et al. "N'-Acyl and N'-nitroso pyridine alkaloids in alkaloid lines of burley tobacco during growth and air-curing" *J. Agric. Food Chem.* 1989, 37, 1, 44-50.

Andersen, R. et al. "Effect of Storage Conditions on Nitrosated, Acylated, and Oxidized Pyridine Alkaloid Derivatives in Smokeless Tobacco Products" *Canc. Res.* 1989, 49, 5895-5900.

Borgerding, M. et al. "Chemical and biological studies of a new cigarette that primarily heats tobacco.: Part 1. Chemical composition of mainstream smoke" *Food Chem. Toxicol.* 1998, 36, 169-182.

Brunnemann, K. et al. "Tobacco-specific nitrosamines in the saliva of Inuit snuff dippers in the Northwest Territories of Canada" *Canc. Lett.* 1987, 37, 7-16.

Burton, H. et al. "Distribution of tobacco constituents in tobacco leaf tissue. 1. Tobacco-specific nitrosamines, nitrate, nitrite, and alkaloids" *J. Agric. Food Chem.* 1992, 40, 1050-1055.

Bush et al., *Coresta Bulletin Information*, Abstract, 9814, 1995.

Chamberlain, W. et al. "Chemical Composition of Nonsmoking Tobacco Products" *J. Agric. Food Chem.* 1988, 36, 48-50.

Choe, E., Min, D. B., "Mechanisms of Antioxidants in the Oxidation of Foods", *Comprehensive Reviews in Food Science and Food Safety*, 8(4), 2009.

DeRoton et al., "Factors Influencing the Formation of Tobacco-Specific Nitrosamines in French Air-Cured Tobaccos in Trials and at the Farm Level" *Beitrage Tabakforsch. Int.*, 21, 305-320 (2005).

Djordjevic, M. et al. "Tobacco-specific nitrosamine accumulation and distribution in flue-cured tobacco alkaloid isolines" *J. Agric. Food Chem.* 1982, 37, 752-756.

Hecht, S. "Biochemistry, Biology, and Carcinogenicity of Tobacco-Specific N-Nitrosamines" *Chem. Res. Toxicol.* 1998, 11, 6, 559-603.

Hecht, S. "DNA adduct formation from tobacco-specific N-nitrosamines" *Mut. Res.* 1999, 424, 1-2, 127-142.

Hoffmann, D. et al. "The changing cigarette, 1950-1995" *J. Toxicol. Env. Hlth.* 1997, 50, 307-364.

Müller et al. "Isolation and Characterization of Cell Lines of nicotiana tabacum Lacking Nitrate Reductase" *Molec. Gen. Genet.* 1978, 161, 67-76.

Nestor et al. "Role of Oxides of Nitrogen in Tobacco-Specific Nitrosamine Formation in Flue-Cured Tobacco" *Beitrage Tabakforsch. Int.* 2003, 20, 467-475.

Osterdahl, B.-G. "The migration of tobacco-specific nitrosamines into the saliva of chewers of nicotine-containing chewing gum" *Food Chem. Toxic.* 1990, 28, 9, 619-622.

(56) References Cited

OTHER PUBLICATIONS

Parker, M.S. "Some effects of preservatives on the development of bacterial spores." *J. Appl. Bacterial*. 1969, 32:322-328.
Smoot, L and M. D. Pierson, "Inhibition and Control of Bacterial Spore Germination", *Journal of Food Protection*, 1982, 45, No. I, pp. 84-92.
Spiegelhalder, B. et al. "Tobacco-specific nitrosamines" *Euro. J. Canc. Prev*. 1996, 5, 1, 33-38.
Staaf, M. et al., "Formation of Tobacco-Specific Nitrosamines (TSNA) During Air-Curing" *Beitrage Tabakforsch. Int*. 2005, 21, 6, 321-33.
Tricker, A. "The occurrence of N-nitro compounds in zarda tobacco" *Canc. Lett*. 1998, 42, 113-118.
Wiernik, A. et al. "Effect of air-curing on chemical composition of tobacco" *Rec. Adv. Tob. Sci*. 1995, 21, 39-80.

* cited by examiner

Formulation with TBHQ

STABILIZER FOR MOIST SNUFF

FIELD OF THE DISCLOSURE

The present disclosure relates to products made or derived from tobacco, or that otherwise incorporate tobacco, and are intended for human consumption.

BACKGROUND

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user.

Various types of smokeless tobacco products are known. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; 2010/0291245 to Gao et al; and 2011/0139164 to Mua et al.; PCT WO 04/095959 to Arnarp et al. and WO 2010/132444 to Atchley; each of which is incorporated herein by reference.

One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. are marketed under the tradenames CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S.

Smokeless Tobacco Company; and MARLBORO Snus and Taboka by Philip Morris USA. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek® standard (see, e.g., https://www.swedishmatch-.com/Snus-and-health/GOTHIATEK/GOTHIATEK-standard/and Runquist et al., Harm Reduction Journal 2011, 8:11).

It would be desirable in the art to provide moist smokeless tobacco products intended for oral use which exhibit improved storage stability. Examples of improving storage stability include, generally, suppressing undesirable enzymatic and microbial activity and specifically, improving the flavor profile, retaining moisture, maintaining or enhancing levels of acetate and citrate, and suppressing nitrite and tobacco specific nitrosamine (TSNA) formation. Maintaining or suppressing such characteristics during storage is particularly challenging due to the high moisture content of moist smokeless tobacco products, which may promote undesirable enzymatic and microbial activity leading to product degradation. Accordingly, methods of stabilizing moist smokeless tobacco products are needed.

BRIEF SUMMARY

The present disclosure provides a method for improving the storage stability of a moist smokeless tobacco product configured for oral use, and further provides storage-stabilized moist smokeless tobacco products. The methods and moist smokeless tobacco products rely on the surprising finding that adding one or more antioxidants and one or more preservatives to a moist tobacco material improves the storage stability of such tobacco materials, in some cases providing a synergistic effect.

Accordingly, in one aspect, the disclosure relates to a method for improving the storage stability of a moist smokeless tobacco product configured for oral use, the moist smokeless tobacco product comprising a tobacco formulation comprising a tobacco material, the method comprising mixing the tobacco material with one or more antioxidants and one or more preservatives to form the tobacco formulation.

In some embodiments, the moist smokeless tobacco product is in the form of moist snuff.

In some embodiments, the tobacco formulation comprises a tobacco material having a moisture content of from about 40% to about 70%, about 45 to about 65%, or about 50 to about 60%. In some embodiments, the tobacco formulation comprises a tobacco material having a moisture content of from about 50% to about 60%. In some embodiments, the tobacco formulation comprises a tobacco material having a water activity (Aw) of from about 0.85 to about 0.88.

In some embodiments, the one or more antioxidants are added in an amount to provide an initial total antioxidant concentration in the tobacco formulation of from about 1 part per million (ppm) to about 1000 ppm, from about 10 ppm to about 500 ppm, or from about 100 ppm to about 300 ppm by weight on a dry weight basis.

In some embodiments, the one or more antioxidants are selected from the group consisting of ascorbic acid, sodium ascorbate, calcium ascorbate, ascorbyl palmitate, citric acid, Vitamin E or a derivative thereof, a tocopherol, propyl gallate, octyl gallate, dodecyl gallate, monosterol citrate, epicatechol, epigallocatechol, epigallocatechol gallate, erythorbic acid, sodium erythorbate, 4-Hexylresorcinol, theaflavin, theaflavin monogallate A or B, theaflavin digallate, phenolic acids, glycosides, quercitrin, isoquercitrin, hyperoside, polyphenols, catechols, resveratrols, oleuropein, butylated hydroxyanisole (BHA), butylated hydroxytoluene (BHT), tertiary butylhydroquinone (TBHQ), and combinations thereof. In some embodiments, the antioxidant is TBHQ.

In some embodiments, the one or more preservatives are added in an amount to provide an initial total preservative concentration in the tobacco formulation of from about 1 part per million (ppm) to about 10,000 ppm, from about 10 ppm to about 5000 ppm, or from about 100 ppm to about 1000 ppm by weight on a dry weight basis. In some embodiments, the one or more preservatives are selected from the group consisting of methylparaben, propylparaben, sodium propionate, potassium sorbate, sodium benzoate, and combinations thereof. In some embodiments, the preservative is propylparaben. In some embodiments, the antioxidant is TBHQ and the preservative is propylparaben. In some embodiments, the initial concentration of TBHQ is about 300 ppm, and the initial concentration of propylparaben is about 1000 ppm.

In some embodiments, the method further comprises adding one or more additional components to the tobacco formulation, the additional components selected from the group consisting of flavorants, fillers, binders, pH adjusters, buffering agents, colorants, disintegration aids, and humectants.

In some embodiments, a concentration of citrate in the tobacco formulation is maintained between about 1% and about 2% for a storage period of at least about 10 days.

In some embodiments, a water activity (Aw) value is maintained between about 0.85 and about 0.88 for a storage period of at least about 10 days.

In some embodiments, the pH of the smokeless tobacco product is maintained between about 7.5 and about 8.1 for a storage period of at least about 10 days.

In some embodiments, a concentration of acetate is maintained between about 1% and about 4% over a storage period of at least about 10 days.

In some embodiments, a concentration of nitrite is maintained below about 10 ppm for a storage period of at least about 10 days.

In some embodiments, a tobacco-specific nitrosamines (TSNA) concentration is maintained below about 50 ppm on a dry weight basis for a storage period of at least about 10 days. In some embodiments, a TSNA concentration of the tobacco formulation is reduced over a storage period of at least about 10 days relative to a control tobacco formulation which does not contain the one or more antioxidants and the one or more preservatives.

The present disclosure also provides a smokeless tobacco configured for oral use, the moist smokeless tobacco prepared according to the methods disclosed herein.

In another aspect, the disclosure provides a smokeless tobacco product comprising a moist smokeless tobacco product configured for oral use, the moist smokeless tobacco product comprising a tobacco material, one or more antioxidants, and one or more preservatives. In some embodiments, the moist smokeless tobacco product is in the form of moist snuff.

In some embodiments, the moist smokeless tobacco product has a moisture content of from about 40% to about 70%, about 45 to about 65%, or about 50 to about 60%. In some embodiments, the moist smokeless tobacco product has a moisture content of from about 50% to about 60%. In some embodiments, the moist smokeless tobacco product has a water activity (Aw) of about 0.85 to about 0.88.

In some embodiments, the one or more antioxidants are present in the moist smokeless tobacco product in a total antioxidant concentration of from about 1 part per million (ppm) to about 1000 ppm, from about 10 ppm to about 500 ppm, or from about 100 ppm to about 300 ppm. In some embodiments, the one or more antioxidants are selected from the group consisting of ascorbic acid, sodium ascorbate, calcium ascorbate, ascorbyl palmitate, citric acid, Vitamin E or a derivative thereof, a tocopherol, propyl gallate, octyl gallate, dodecyl gallate, monosterol citrate, epicatechol, epigallocatechol, epigallocatechol gallate, erythorbic acid, sodium erythorbate, 4-Hexylresorcinol, theaflavin, theaflavin monogallate A or B, theaflavin digallate, phenolic acids, glycosides, quercitrin, isoquercitrin, hyperoside, polyphenols, catechols, resveratrols, oleuropein, butylated hydroxyanisole (BHA), butylated hydroxytoluene (BHT), tertiary butylhydroquinone (TBHQ), and combinations thereof. In some embodiments, the one or more antioxidants is TBHQ.

In some embodiments, the one or more preservatives are present in the tobacco formulation in a total preservative concentration of from about 1 part per million (ppm) to about 10,000 ppm, from about 10 ppm to about 5000 ppm, or from about 100 ppm to about 1000 ppm. In some embodiments, the preservative is selected from the group consisting of methyl paraben, propylparaben, sodium propionate, potassium sorbate, sodium benzoate, and combinations thereof. In some embodiments, the preservative is propylparaben. In some embodiments, the antioxidant is TBHQ and the preservative is propylparaben. In some embodiments, the initial concentration of TBHQ is about 300 ppm, and the initial concentration of propylparaben is about 1000 ppm.

In some embodiments, the moist smokeless tobacco product further comprises one or more additional components selected from the group consisting of flavorants, fillers, binders, pH adjusters, buffering agents, colorants, disintegration aids, and humectants.

In some embodiments, the moist smokeless tobacco product is characterized, after a storage period of at least about 10 days, by a concentration of citrate between about 1% and about 2%. In some embodiments, the moist smokeless tobacco product is characterized, after a storage period of at least about 10 days, by a concentration of acetate between about 1% and about 4%.

In some embodiments, the moist smokeless tobacco product is characterized, after a storage period of at least about 10 days, by an Aw value between about 0.85 and about 0.88.

In some embodiments, the moist smokeless tobacco product is characterized, after a storage period of at least about 10 days, by a pH between about 7.5 and about 8.1.

In some embodiments, the moist smokeless tobacco product is characterized, after a storage period of at least about 10 days, by a concentration of nitrite below about 10 ppm.

In some embodiments, the moist smokeless tobacco product is characterized, after a storage period of at least about 10 days, by a TSNA concentration that is reduced relative to a control moist smokeless tobacco product which does not comprise the one or more antioxidants and the one or more preservatives. In some embodiments, the moist smokeless tobacco product is characterized, after a storage period of at least about 10 days, by a TSNA concentration below about 50 ppm on a dry weight basis.

In some embodiments, the storage period is from about 10 days to about 150 days. In some embodiments, the storage period is about 10 days, about 20 days, about 30 days, about 40 days, about 60 days, about 80 days, about 100 days, about 120 days, about 140 days, or about 150 days.

DETAILED DESCRIPTION

Figure 1:
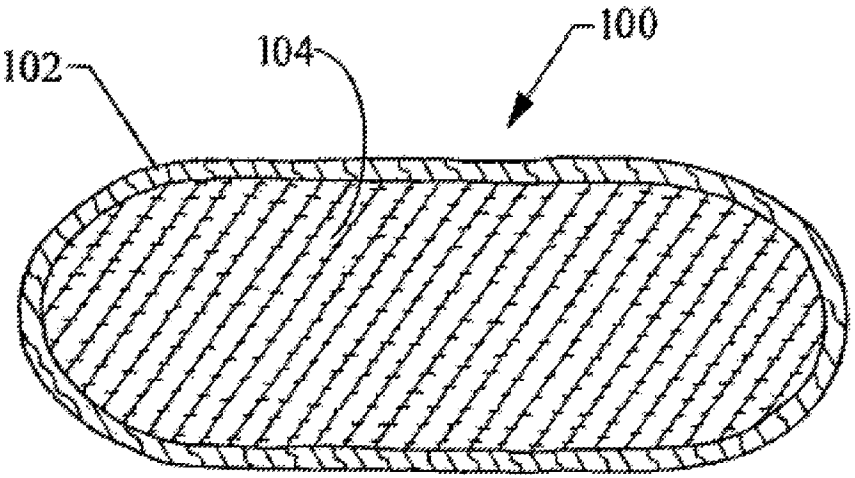
FIG. 1 is a cross-sectional view of a smokeless tobacco product embodiment, taken across the width of the product, showing an outer pouch filled with a smokeless tobacco composition of the present disclosure.

For both customer satisfaction and simplification of production, it is desirable to provide a moist smokeless tobacco product with a high moisture content. Moist smokeless tobacco products with a high moisture content typically exhibit less storage stability relative to moist smokeless tobacco products having a lower moisture content. In particular, a high moisture content is associated with certain degradations in product quality upon extended product storage, as higher moisture content promotes microbial growth and enzymatic reactions leading to unfavorable characteristics. Surprisingly, according to the present disclosure, it has been found that, in certain embodiments, a combination of an antioxidant and a preservative provides a moist smokeless tobacco product which exhibits a favorable profile with respect to one or more of pH, moisture content, nitrite content, TSNA content, and organic acid component content over a storage period, relative to a moist smokeless tobacco product which has not been produced according to the disclosed method. Accordingly, the present disclosure provides a method for improving the storage stability of a moist smokeless tobacco product configured for oral use, and provides a moist smokeless tobacco product configured for oral use, the moist smokeless tobacco product comprising a tobacco material, one or more antioxidants, and one or more preservatives.

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Tobacco Formulation

The moist smokeless tobacco product comprises a tobacco formulation comprising a tobacco material, one or more antioxidants and one or more preservatives. The individual components of the tobacco formulation are described herein below.

Tobacco Material

The tobacco material of the present disclosure can vary in species, type, and form. Generally, the tobacco material is obtained from for a harvested plant of the *Nicotiana* species. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.* x *sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii*. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Descriptions of various types of tobaccos, growing practices and harvesting practices are set forth in

*Tobacco Production, Chemistry and Technology*, Davis et al. (Eds.) (1999), which is incorporated herein by reference.

*Nicotiana* species from which suitable tobacco materials can be obtained can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

The *Nicotiana* species can, in some embodiments, be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be included within a tobacco formulation as disclosed herein. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material comprises tobacco leaf (lamina). The tobacco formulations disclosed herein can have the form of processed tobacco parts or pieces, cured and aged tobacco in essentially natural lamina and/or stem form, a tobacco extract, extracted tobacco pulp (e.g., using water as a solvent), or a mixture of the foregoing (e.g., a mixture that combines extracted tobacco pulp with granulated cured and aged natural tobacco lamina).

In certain embodiments, the tobacco material comprises solid tobacco material selected from the group consisting of lamina and stems. The tobacco that is used for the tobacco formulation most preferably includes tobacco lamina, or a tobacco lamina and stem mixture (of which at least a portion is smoke-treated). Portions of the tobaccos within the tobacco formulation may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the tobacco formulation optionally may incorporate tobacco that has been fermented. See, also, the types of tobacco processing techniques set forth in PCT WO2005/063060 to Atchley et al., which is incorporated herein by reference.

The tobacco material is typically used in a form that can be described as particulate (i.e., shredded, ground, granulated, or powder form). The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent. Most preferably, the tobacco material is employed in the form of parts or pieces that have an average particle size between 1.4 millimeters and 250 microns. In some instances, the tobacco particles may be sized to pass through a screen mesh to obtain the particle size range required. If desired, air classification equipment may be used to ensure that small sized tobacco particles of the desired sizes, or range of sizes, may be collected. If desired, differently sized pieces of granulated tobacco may be mixed together.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. The tobacco material can be processed to provide it in the desired form before and/or after being subjected to the method comprising mixing the tobacco material with one or more antioxidants and one or more preservatives to form the tobacco formulation described herein.

For example, the tobacco plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

For the preparation of moist smokeless tobacco products, it is typical for a harvested plant of the *Nicotiana* species to be subjected to a curing process. The tobacco materials incorporated within tobacco formulations for inclusion within moist smokeless tobacco products as disclosed herein are those that have been appropriately cured and/or aged. Descriptions of various types of curing processes for various types of tobaccos are set forth in *Tobacco Production,*

*Chemistry and Technology*, Davis et al. (Eds.) (1999). Examples of techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330 (2005), which are incorporated herein by reference. Certain types of tobaccos can be subjected to alternative types of curing processes, such as fire curing or sun curing.

In certain embodiments, tobacco materials that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Madole, Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos and various blends of any of the foregoing tobaccos.

The tobacco within a tobacco formulation also may have a so-called "blended" form. For example, the tobacco within a tobacco formulation of the present disclosure may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other example tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other example tobacco blends incorporate about 20 to about 30 parts Oriental tobacco and about 70 to about 80 parts flue-cured tobacco.

The tobacco materials described in the present invention can be treated and/or processed in other ways before or after mixing the tobacco material with the one or more antioxidants and the one or more preservatives to form the tobacco formulation. Tobacco materials used in the present disclosure can be subjected to, for example, fermentation, bleaching, and the like. If desired, the tobacco materials can be, for example, irradiated, pasteurized, or otherwise subjected to controlled heat treatment. Such treatment processes are detailed, for example, in U.S. Pat. No. 8,061,362 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, cysteine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. See, for example, the types of treatment processes described in U.S. Pat. Nos. 8,434,496, 8,944,072, and 8,991,403 to Chen et al., which are all incorporated herein by reference. In certain embodiments, this type of treatment is useful where the original tobacco material is subjected to heat in the processes previously described.

In some embodiments, the one or more antioxidants and one or more preservatives as disclosed herein are admixed with a tobacco material prior to or during a fermentation step. In some embodiments, the one or more antioxidants and one or more preservatives as disclosed herein are admixed with a tobacco material after a fermentation step.

The moisture content of the moist smokeless tobacco product, the tobacco formulation, and the tobacco material as disclosed herein can vary. It is generally desirable to provide a moist smokeless tobacco product having a particular range of moisture content. In some embodiments, the tobacco formulation comprises a tobacco material having a moisture content of from about 40% to about 70%, about 45 to about 65%, or about 50 to about 60%. In some embodiments, the tobacco formulation comprises a tobacco material having a moisture content of from about 50% to about 60%.

Antioxidants and Preservatives

The tobacco formulation as disclosed herein comprises one or more antioxidants. As used herein, the term "antioxidant" refers to a compound added to the formulation to prevent or suppress oxidation by terminating free radical reactions. Particularly in the context of high moisture content tobacco materials as disclosed herein, the presence oxygen and/or free radicals may lead to undesirable oxidation reactions resulting in degradation of certain product characteristics during storage. Without wishing to be bound be theory, it is believed that the presence of antioxidants suppresses oxidation reactions which otherwise may result in diminishing acetate and citrate concentration, and increasing nitrite and TSNA concentration, during storage.

In some embodiments, the one or more antioxidants are selected from the group consisting of ascorbic acid, sodium ascorbate, calcium ascorbate, ascorbyl palmitate, citric acid, Vitamin E or a derivative thereof, a tocopherol, propyl gallate, octyl gallate, dodecyl gallate, monosterol citrate, epicatechol, epigallocatechol, epigallocatechol gallate, erythorbic acid, sodium erythorbate, 4-Hexylresorcinol, theaflavin, theaflavin monogallate A or B, theaflavin digallate, phenolic acids, glycosides, quercitrin, isoquercitrin, hyperoside, polyphenols, catechols, resveratrols, oleuropein, butylated hydroxyanisole (BHA), butylated hydroxytoluene (BHT), tertiary butylhydroquinone (TBHQ), and combinations thereof. In some embodiments, the antioxidant is TBHQ.

The quantity of antioxidant added to the tobacco material, as well as the antioxidant concentration in the formulation over time, can vary. In some embodiments, the one or more antioxidants are added in an amount to provide an initial total antioxidant concentration in the tobacco formulation of from about 1 part per million (ppm) to about 1000 ppm, from about 10 ppm to about 500 ppm, or from about 100 ppm to about 300 ppm by weight on a dry weight basis. For example, in some embodiments, the initial total antioxidant concentration is about 1000 ppm, about 900 ppm, about 800 ppm, about 700 ppm, about 600 ppm, about 500 ppm, about 400 ppm, about 300 ppm, about 250 ppm, about 200 ppm, about 150 ppm, or about 100 ppm.

The tobacco formulation as disclosed herein comprises one or more preservatives. As used herein, the term "preservative" refers to a substance added to the formulation to prevent decomposition associated with microbial growth. Particularly in the context of high moisture content tobacco materials as disclosed herein, microbial growth may lead to undesirable enzymatic reactions resulting in degradation of certain product characteristics during storage. Without wishing to be bound be theory, it is believed that the presence of preservatives has a synergistic effect with antioxidants in diminishing formation of nitrite and TSNAs, and maintaining the presence of desirable organic acids, moisture content, and pH.

In some embodiments, the one or more preservatives are selected from the group consisting of methylparaben, propylparaben, sodium propionate, potassium sorbate, sodium benzoate, and combinations thereof. In some embodiments, the preservative is propylparaben. The quantity of preservative added to the tobacco material can vary, as can the quantity of preservative present in the formulation over a storage period. In some embodiments, the one or more preservatives are added in an amount to provide an initial total preservative concentration in the tobacco formulation of from about 1 part per million (ppm) to about 10,000 ppm, from about 10 ppm to about 5000 ppm, or from about 100 ppm to about 1000 ppm by weight on a dry weight basis. For example, in some embodiments, the initial total preservative concentration is about 10,000 ppm, about 5000 ppm, about 2500 ppm, about 1000 ppm, about 900 ppm, about 800 ppm, about 700 ppm, about 600 ppm, about 500 ppm, about 400 ppm, about 300 ppm, about 250 ppm, about 200 ppm, about 150 ppm, or about 100 ppm. One of skill in the art will recognize that antioxidant may decrease from the initial concentration over the time of the storage period due to consumption in free radical oxidation reactions.

In specific embodiments, the antioxidant is TBHQ and the preservative is propylparaben. In specific embodiments, the initial concentration of TBHQ is about 300 ppm, and the initial concentration of propylparaben is about 1000 ppm.

Additional Components

Depending on the type of moist smokeless tobacco product desired, the tobacco formulation as disclosed herein can include one or more additional components beyond the tobacco material, antioxidants, and preservatives as described above. For example, the tobacco material can be processed, blended, formulated, combined and/or mixed with other materials or ingredients, such as other tobacco materials or flavorants, fillers, binders, pH adjusters, buffering agents, salts, sweeteners, colorants, oral care additives, disintegration aids, and humectants. See, for example, those representative components, combination of components, relative amounts of those components and ingredients relative to tobacco, and manners and methods for employing those components, set forth in U.S. Pat. No. 9,237,769 to Mua et al. and U.S. Pat. No. 7,861,728 to Holton, Jr. et al. and US Pat. App. Pub. No. 2007/0062549 to Holton, Jr. et al., each of which is incorporated herein by reference. In some embodiment, the moist smokeless tobacco product further comprises one or more additional components selected from the group consisting of flavorants, fillers, binders, pH adjusters, buffering agents, colorants, disintegration aids, and humectants.

As used herein, a "flavorant" or "flavoring agent" is any flavorful or aromatic substance capable of altering the sensory characteristics associated with the smokeless tobacco composition. Examples of sensory characteristics that can be modified by the flavorant include taste, mouthfeel, moistness, coolness/heat, and/or fragrance/aroma. Examples of flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Flavorants may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. The amount of flavorants utilized in the tobacco formulation can vary, but is typically up to about 10 dry weight percent, and certain embodiments are characterized by a flavorant content of at least about 1 dry weight percent, such as about 1 to about 10 dry weight percent. Sweeteners can be used in natural or artificial form or as a combination of artificial and natural sweeteners. In one embodiment, sucralose is a primary sweetener ingredient. When present, a representative amount of sweetener, whether an artificial sweetener and/or natural sugar, may make up at least about 0.2 percent or at least about 5 percent, of the total dry weight of the composition. Preferably, the amount of sweetener within the composition will not exceed about 40 percent, often will not exceed about 35 percent, and frequently will not exceed about 30 percent, of the total dry weight of the composition. Combinations of flavorants are often used, such as about 0.1 to about 2 dry weight percent of an artificial sweetener, about 0.5 to about 8 dry weight percent of a salt such as sodium chloride and about 1 to about 5 dry weight percent of an additional flavoring.

The smokeless tobacco compositions of the disclosure may typically include at least one filler ingredient in addition to the polysaccharide filler component. Such components of the composition often fulfill multiple functions, such as enhancing certain organoleptic properties such as texture and mouthfeel, enhancing cohesiveness or compressibility of the product, and the like. Examples of filler materials include vegetable fiber materials such as sugar beet fiber materials (e.g., FIBREX® brand filler available from International Fiber Corporation), oats or other cereal grain (including processed or puffed grains), bran fibers, starch, or other modified or natural cellulosic materials such as microcrystalline cellulose. Additional specific examples include corn starch, maltodextrin, dextrose, calcium carbonate, calcium phosphate, lactose, manitol, xylitol, and sorbitol. The amount of filler, where utilized in the tobacco formulation, can vary, but is typically up to about 20 dry weight percent, and certain embodiments are characterized by a filler content of up to about 10 dry weight percent, up to about 5 dry weight percent or up to about 1 dry weight percent. Combinations of fillers can also be used.

A binder may be employed in amounts sufficient to provide the desired physical attributes and physical integrity to the smokeless tobacco composition. Typical binders can be organic or inorganic, or a combination thereof. Representative binders include povidone, sodium carboxymethylcellulose and other modified cellulosic materials, sodium alginate, xanthan gum, starch-based binders, gum arabic, pectin, carrageenan, pullulan, zein, guar gum, ghatti gum, gum tragacanth, karaya gum, locust bean gum, gellan gum, and the like, and combinations thereof. The amount of binder utilized in the tobacco formulation can vary, but is typically up to about 30 dry weight percent, and certain embodiments are characterized by a binder content of at least about 5 dry weight percent, such as about 5 to about 30 dry weight percent.

An emulsifier may be employed in amounts sufficient to provide desired stabilization attributes to the smokeless tobacco composition. When present, a representative amount of emulsifier will typically make up less than about 5 percent of the total dry weight of the composition.

Preferred pH adjusters or buffering agents provide and/or buffer within a pH range of about 6 to about 10, and example agents include metal hydroxides, metal carbonates, metal bicarbonates, and mixtures thereof. Specific example materials include citric acid, sodium hydroxide, potassium hydroxide, potassium carbonate, sodium carbonate, and sodium bicarbonate. The amount of pH adjuster or buffering material utilized in the tobacco formulation can vary, but is typically up to about 5 dry weight percent, and certain embodiments can be characterized by a pH adjuster/buffer content of less than about 0.5 dry weight percent, such as about 0.05 to about 0.2 dry weight percent. Particularly in embodiments comprising an extract clarified by distillation, the pH may be lowered by the addition of one or more pH adjusters (e.g., citric acid).

A colorant may be employed in amounts sufficient to provide the desired physical attributes to the tobacco formulation. Examples of colorants include various dyes and pigments, such as caramel coloring and titanium dioxide. The amount of colorant utilized in the tobacco formulation can vary, but is typically up to about 3 dry weight percent, and certain embodiments are characterized by a colorant content of at least about 0.1 dry weight percent, such as about 0.5 to about 3 dry weight percent.

A humectant (e.g., glycerin) may be employed in amounts sufficient to provide desired moisture attributes to the smokeless tobacco composition. When present, a representative amount of humectant will typically make up at least about 1 percent of the total dry weight of the composition, and often at least about 2 percent by weight. In certain embodiments, the amount of humectants is at least about 10 dry weight percent or at least about 20 dry weight percent. An example dry weight range is about 1 to about 40 weight percent, more often about 3 to about 35 dry weight percent.

Other ingredients such as disintegration aids (e.g., microcrystalline cellulose, croscarmellose sodium, crospovidone, sodium starch glycolate, pregelatinized corn starch, and the like) can also be used. Typically, such ingredients, where used, are used in amounts of up to about 10 dry weight percent and usually at least about 0.1 dry weight percent, such as about 0.5 to about 10 dry weight percent. A disintegration aid is generally employed in an amount sufficient to provide control of desired physical attributes of the tobacco formulation such as, for example, by providing loss of physical integrity and dispersion of the various component materials upon contact of the formulation with water (e.g., by undergoing swelling upon contact with water).

As noted, in some embodiments, any of the components described above can be added in an encapsulated form (e.g., in the form of microcapsules), the encapsulated form a wall or barrier structure defining an inner region and isolating the inner region permanently or temporarily from the tobacco composition. The inner region includes a payload of an additive either adapted for enhancing one or more sensory characteristics of the smokeless tobacco product, such as taste, mouthfeel, moistness, coolness/heat, and/or fragrance, or adapted for adding an additional functional quality to the smokeless tobacco product. See, for example, the subject matter of U.S. Pat. No. 8,061,362 to Mua et al., which is incorporated herein by reference.

Representative tobacco formulations may incorporate about 80% to about 95% percent tobacco material, and in addition to the one or more antioxidants and one or more preservatives as disclosed herein, about 0.1% to about 5% artificial sweetener, about 0.5% to about 2% salt, about 1% to about 5% flavoring, about 1% to about 5% humectants (e.g., propylene glycol), and up to about 10% pH adjuster or buffering agent (e.g., sodium bicarbonate or citric acid), based on the total dry weight of the tobacco formulation. The particular percentages and choice of ingredients will vary depending upon the desired flavor, texture, and other characteristics.

Method of Improving Storage Stability and Improved Storage Stability Characteristics The method of improving the storage stability as disclosed herein generally comprises mixing the tobacco material as disclosed herein with one or more antioxidants and one or more preservatives as disclosed herein to form a tobacco formulation. The components of the tobacco formulation can be brought together in admixture using any mixing technique or equipment known in the art. The components noted above, which may be in liquid or dry solid form, can be admixed with tobacco material in a pretreatment step prior to mixture with any remaining components of the formulation or simply mixed with the tobacco material together with all other liquid or dry ingredients. Any mixing method that brings the tobacco formulation ingredients into intimate contact can be used. A mixing apparatus featuring an impeller or other structure capable of agitation is typically used. Examples of mixing equipment include casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, and the like. As such, the overall mixture of various components with the tobacco material may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

In some embodiments, the one or more antioxidants and one or more preservatives as disclosed herein are admixed with a moist smokeless tobacco prior to fermentation. In some embodiments the one or more antioxidants and one or more preservatives as disclosed herein are admixed with a tobacco material after a fermentation step. In some embodiments the one or more antioxidants and one or more preservatives as disclosed herein are admixed with a tobacco material both before and after a fermentation step The moist smokeless tobacco product provided herein exhibits improved storage stability relative to a control smokeless tobacco product which does not contain the one or more antioxidants and the one or more preservatives as described herein. The improvement in stability with respect to storage comprises maintaining or improving a number of characteristics of the moist smokeless tobacco product over a storage period.

Nitrosamines (containing the nitroso-amine group, N—N═O) are known to be present in air, foods, beverages, cosmetics, and even pharmaceuticals. Preussman, R. et al., In *Chemical Carcinogens,* 2nd ed., Vol. 2, Searle, C. E. (Ed.); ACS Monograph 182; 1984; pp 829-868. Tobacco and tobacco smoke also are known to contain nitrosamines. Green et al. *Rec. Adv. Tob. Sci.* 1996, 22, 131. Tobacco is known to contain a class of nitrosamines known as tobacco-specific nitrosamines (TSNAs). Hecht, S. *Chem. Res. Toxicol.* 1998, 11, 6, 559-603; Hecht, S. Mut. Res. 1999, 424, 1-2, 127-142. TSNAs have been reported to be present in smokeless tobacco (see, e.g., Brunnemann, K. et al. *Canc. Lett.* 1987, 37, 7-16, Tricker, A. *Canc. Lett.* 1988, 42, 113-118, Andersen, R. et al. *Canc. Res.* 1989, 49, 5895-5900); cigarette smoke (see, e.g., Spiegelhalder, B. et al. *Euro. J. Canc. Prev.* 1996, 5, 1, 33-38; Hoffmann, D. et al. *J. Toxicol. Env. Hlth.* 1997, 50, 307-364; Borgerding, M. et al. *Food Chem. Toxicol.* 1998, 36, 169-182); nicotine-containing gum (see, e.g., Osterdahl, B.-G. *Food Chem. Toxic.* 1990, 28, 9, 619-622); and a nicotine-containing transdermal patch (see, e.g., Adlkofer, F. In *Effects of Nicotine on Biological Systems II*, Clarke, P. et al. (Eds.); 1998, pp 17-25).

TSNAs are classified as electrophilic alkylating agents, and it is therefore desirable to minimize their presence in tobacco products to reduce the potential for consumer exposure. Examples of TSNAs are N-nitrosonornicotine (NNN), 4-methyl-N-nitrosamino-1-(3-pyridyl)-1-butanone (NNK), N-nitrosoanatabine (NAT), 4-methyl-N-nitrosamino-1-(3-pyridyl)-1-butanol (NNAL), and N-nitrosoanabasine (NAB). The two TSNAs of greatest concern are N'-nitrosonornicotine (NNN) and 4-(N-nitrosomethylamino)-1-(3-pyridyl)-1-butanone (NNK). Of these two, NNK is of the greatest concern.

Green and freshly harvested tobaccos have been reported to be virtually free of TSNAs. Parsons, A. *Tob. Sci.* 1986, 30, 81-82; Spiegelhalder, B. et al. *Euro. J. Canc. Prev.* 1996, 5, 1, 33-38; Brunnemann, K. et al. *J. Toxicol.-Clin. Toxicol.* 1982-3, 19, 6&7, 661-668; Andersen, R. et al. *J. Agric. Food Chem.* 1989, 37, 1, 44-50; Djordjevic, M. et al. *J. Agric. Food Chem.* 1989, 37, 752-756. However, it has been observed that TSNAs form during the post-harvest processing to which tobacco is subjected. Tricker, A. *Canc. Lett.* 1998, 42, 113-118; Chamberlain, W. et al. 1 *Agric. Food Chem.* 1988, 36, 48-50. TSNAs are recognized as being formed when tobacco alkaloids, such as nicotine and nornicotine, are nitrosated by reaction between nitrite and tobacco alkaloids. Hecht, S. *Chem. Res. Toxicol.* 1998, 11, 6, 559-603. This nitrosation may occur during the processing and storage of tobacco, and by combustion of tobacco containing nicotine and nornicotine in a nitrate-rich environment.

Significant efforts have been expended towards studying the mechanism of TSNA formation during tobacco curing. For example, it has been postulated that TSNAs form during the air-curing of Burley tobacco as a result of microbial mediated conversion of nitrate to nitrite. Once the conversion to nitrite is effected, numerous reactive nitrogen/oxygen compounds can be produced in a cascade of chemical conversions of nitrous acid to dinitrogen trioxide, dinitrogen tetroxide and nitric oxide, for example. TSNAs are formed by the subsequent reaction of these nitrate-derived chemical species with alkaloids present in the tobacco. Hamilton et al. *Tob. Sci.* 26, 133-137 (1982); Burton, H. et al. *J. Agric. Food Chem.* 1992, 40, 1050-1055; Bush et al., *Coresta Bulletin Information* 1995, Abstract, 9814; Wiernik, A. et al. *Rec. Adv. Tob. Sci.* 21, 39-80 (1995); Cui et al., TCRC (1996); deRoton, C. et al. *Beitrage Tabakforsch. Int.* 2005, 21, 6, 305-320; and Staaf, M. et al., *Beitrage Tabakforsch. Int.* 2005, 21, 6, 321-330. Specifically, bacteria (e.g., gram negative bacteria) can produce the enzyme nitrate reductase, which converts nitrates to nitrite and nitric oxide; nitric oxide can subsequently react with precursor tobacco alkaloids to produce TSNAs. Additionally, for example, it has been postulated that TSNAs form during the flue-curing of Virginia tobaccos due to interaction of those tobaccos with nitric oxide combustion products present in exhaust gases produced during use of so-called direct-fired flue-curing barns. U.S. Pat. No. 7,404,406 to Peele; Nestor et al. *Beitrage Tabakforsch. Int.* 2003, 20, 467-475; see also U.S. Pat. No. 7,650,892 to Groves et al.

Various efforts to reduce TSNA levels by modifying the growth or curing process have been attempted. See, for example, U.S. Pat. Nos. 4,343,317 and 4,347,859 to Bokelman; U.S. Pat. No. 5,803,081 to O'Donnell; U.S. Pat. No. 6,202,649 to Williams; U.S. Pat. No. 6,805,134 to Peele; U.S. Pat. No. 7,293,564 to Perfetti et al.; U.S. Pat. No. 7,404,406 to Peele; U.S. Pat. No. 8,353,300 to Li et al.; U.S. Pat. No. 9,066,538 to Chen et al.; U.S. Pat. No. 9,155,334 to Moldoveanu et al.; US Pat. Pub. Nos. 2016/0331020 and US2013/0269719 to Marshall et al., PCT Appl. Publ. Nos. WO 83/01180 to Malik; WO 98/05226 and WO 98/58555 to Williams; WO 01/35770 and WO 02/13636 to Hempfling et al., and WO 03/094639 to Koga et al., and Müller et al. *Molec. Gen. Genet.* 1987, 161, 67-76, which are all incorporated herein by reference.

Additional efforts to reduce or remove TSNAs from tobacco products have been directed toward preventing their formation by 1) inhibiting conversion of nitrate to nitrite; and 2) decreasing the concentration of nitrate present in harvested tobacco leaves. To inhibit reduction of nitrate in the tobacco leaves to nitrite by the function of the nitrate-reducing enzymes produced by microorganisms present on the tobacco leaf surface during the curing process, methods have been proposed to remove or reduce the concentration of such microorganisms. For example, a method of removing such microorganisms by washing with bicarbonate of soda has been reported in PCT Appl. Publ. No. WO 01/35770 to Hempfling et al. Also reported is a method of killing microorganisms with chlorine dioxide gas in PCT Appl. Publ. No. WO 02/13636 to Hempfling et al. Efforts have also been directed toward reducing or eliminating the presence of microorganisms responsible for producing nitrate-reducing enzymes on tobacco leaves by promoting a competitive overgrowth of microorganisms which do not produce nitrate reducing enzymes. For example, PCT Appl. Publ. No. WO 83/01180 to Malik et al. discloses use of a microorganism derived from tobacco leaves. However, while the disclosed method made it possible to decrease the content of nitrate and nitrogen compounds in cured tobacco leaves, it proved insufficient to efficiently reduce TSNA content. U.S. Pat. No. 7,549,425 discloses a method of reducing TSNA content comprising treating tobacco leaves with microorganisms from the *Enterobacter* or *Pantoea* genus. Treatment with probiotics to alter the microbiome present on tobacco leaves has also been disclosed, in, for example, US Patent Application Publication No. 2013/0269719 to Marshall et al.

Despite such efforts to remove or prevent formation of TSNAs in tobacco, it would be useful to provide methods for the prevention of formation of at least a portion of the TSNAs in moist smokeless tobacco products which may otherwise form during storage, and to provide moist smokeless tobacco products having a lower concentration of TSNAs after a storage period. As disclosed herein, high moisture content smokeless tobacco products, by virtue of their high moisture content, are more susceptible to formation of TSNAs during storage. Therefore, methods for reducing formation of TSNAs during storage is particularly valuable for high moisture smokeless tobacco products such as those described herein.

Accordingly, in some embodiments, the moist smokeless tobacco product as disclosed herein is characterized, after a storage period of at least about 10 days, by a tobacco-specific nitrosamine (TSNA) concentration that is reduced relative to a control moist smokeless tobacco product which does not comprise the one or more antioxidants and the one or more preservatives. The TSNA concentration may be measured in various units, for example in relative measures (e.g., weight %, parts per million (ppm), μg/gram, mmol/gram, and the like). Methods for quantitating TSNA concentration are known in the art, for example, using quantitative liquid chromatography-mass spectroscopy (LC-MS).

In certain embodiments, the TSNA concentration can vary but generally, a moist smokeless tobacco product as described herein, after a storage period, will comprise between about 10% and about 90% by weight on a dry weight basis of TSNAs generally as compared with the amount of TSNAs present in a comparable moist smokeless tobacco product which does not comprise the one or more antioxidants and the one or more preservatives as described herein. For example, in certain embodiments, moist smokeless tobacco product may exhibit at least a 10%, 20%, 30%, 40%, 50%, 60%, 70%, 80%, 90%, or greater than 90% decrease in the concentration of one or more than one TSNA by weight on a dry weight basis as compared with a control moist smokeless tobacco product which does not comprise the one or more antioxidants and the one or more preservatives as disclosed herein. In some embodiments, the moist smokeless tobacco product is characterized, after a storage period of at least about 10 days, by a TSNA concentration below about 50 ppm on a dry weight basis.

In some embodiments, the TSNA that is reduced in concentration in the moist smokeless tobacco product after a storage period is NNN, NNK, NAT, NAB, or any combination thereof. For example, in some embodiments, the moist smokeless tobacco product is characterized, after a storage period of at least about 10 days, by a the NNN content of less than about 50 ppm, less than about 25 ppm, less than about 20 ppm, less than about 10 ppm, less than about 9 ppm, less than about 8 ppm, less than about 7 ppm, less than about 6 ppm, less than about 5 ppm, less than about 4 ppm, less than about 3 ppm, less than about 2 ppm, or less than about 1 ppm.

In some embodiments, the moist smokeless tobacco product is characterized, after a storage period of at least about 10 days, by a the NNK content of less than about 50 ppm, less than about 25 ppm, less than about 20 ppm, less than about 10 ppm, less than about 9 ppm, less than about 8 ppm, less than about 7 ppm, less than about 6 ppm, less than about 5 ppm, less than about 4 ppm, less than about 3 ppm, less than about 2 ppm, or less than about 1 ppm.

In some embodiments, the moist smokeless tobacco product is characterized, after a storage period of at least about 10 days, by a the NAT content of less than about 50 ppm, less than about 25 ppm, less than about 20 ppm, less than about 10 ppm, less than about 9 ppm, less than about 8 ppm, less than about 7 ppm, less than about 6 ppm, less than about 5 ppm, less than about 4 ppm, less than about 3 ppm, less than about 2 ppm, or less than about 1 ppm.

In some embodiments, the moist smokeless tobacco product is characterized, after a storage period of at least about 10 days, by a the NAB content of less than about 50 ppm, less than about 25 ppm, less than about 20 ppm, less than about 10 ppm, less than about 9 ppm, less than about 8 ppm, less than about 7 ppm, less than about 6 ppm, less than about 5 ppm, less than about 4 ppm, less than about 3 ppm, less than about 2 ppm, or less than about 1 ppm.

In some embodiments, the moist smokeless tobacco product is advantageously characterized, after a storage period of at least about 10 days, by a total combined NNN, NAT, NAB, and NNK content less than about 50 ppm, less than about 25 ppm, less than about 20 ppm, less than about 10 ppm, less than about 9 ppm, less than about 8 ppm, less than about 7 ppm, less than about 6 ppm, less than about 5 ppm, less than about 4 ppm, less than about 3 ppm, less than about 2 ppm, or less than about 1 ppm.

In some embodiments, a total combined tobacco-specific nitrosamines (TSNA) concentration is maintained below about 50 ppm on a dry weight basis for a storage period of at least about 10 days. In some embodiments, a TSNA concentration of the tobacco formulation is reduced over a storage period of at least about 10 days relative to a control tobacco formulation which does not contain the one or more antioxidants and the one or more preservatives.

As disclosed herein above, the presence of nitrite in a tobacco material may, under certain conditions, be associated with production of TSNAs by nitrosation during storage. Accordingly, it is desirable to maintain a low concentration of nitrite to prevent such reaction.

Advantageously, in some embodiments, the moist smokeless tobacco product as disclosed herein is characterized, after a storage period of at least about 10 days, by a concentration of nitrite below about 10 ppm. In some embodiments, a concentration of nitrite is maintained below about 10 ppm for a storage period of at least about 10 days. Without wishing to be bound by theory, it is believed that the particular combination of an antioxidant and a preservative as described herein has a synergistic effect on the enzymatic and/or chemical reactions responsible for creation of nitrite and/or TSNAs.

It is generally desirable to provide a moist smokeless tobacco product having a certain concentration of various organic acids which contribute to the flavor profile of the product. Preferably, acetic acid and citric acid (measured as acetate and citrate, respectively) are present in a higher concentration relative to malic and lactic acids. Various microbial and enzymatic reactions occurring during storage contribute to the particular distribution of organic acids which may be present. Surprisingly, it has been found that the presence of a preservative and antioxidant effectively maintains a desirable concentration of acetate and citrate, while suppressing formation of lactate and malate. In some embodiments, the moist smokeless tobacco product is characterized, after a storage period of at least about 10 days, by a concentration of citrate between about 1% and about 2%. In some embodiments, the moist smokeless tobacco product is characterized, after a storage period of at least about 10 days, by a concentration of acetate between about 1% and about 4%. In some embodiments, a concentration of citrate in the tobacco formulation is maintained between about 1% and about 2% for a storage period of at least about 10 days. In some embodiments, a concentration of acetate is maintained between about 1% and about 4% over a storage period of at least about 10 days.

The moisture content of the moist smokeless tobacco product, prior to use by a consumer, may vary. In some embodiments, the moist smokeless tobacco product has a moisture content of from about 40% to about 70%, about 45 to about 65%, or about 50 to about 60%. Typically, the moisture content of the product is less than about 55 weight percent, generally is less than about 50 weight percent, and often is less than about 45 weight percent. For certain tobacco products, such as those incorporating snus-types of tobacco compositions, the moisture content may exceed 20 weight percent, and often may exceed 30 weight percent. For example, a representative snus-type product may possess a tobacco composition exhibiting a moisture content of about 20 weight percent to about 50 weight percent, preferably about 20 weight percent to about 40 weight percent.

In some embodiments, the tobacco formulation comprises a tobacco material having a water activity (Aw) of from about 0.85 to about 0.88. As used herein, the term "water activity" or "Aw" refers to the partial vapor pressure of water in a tobacco material divided by the partial vapor pressure of pure water at the same temperature. According to this definition, pure distilled water has an Aw of exactly one. In some embodiments, a water activity (Aw) value is maintained between about 0.85 and about 0.88 for a storage period of at least about 10 days. In some embodiments, the moist smokeless tobacco product is characterized, after a storage period of at least about 10 days, by an Aw value between about 0.85 and about 0.88.

The acidity or alkalinity of the tobacco formulation, which is often characterized in terms of pH, can vary. Typically, the pH of that formulation is at least about 6.5, and preferably at least about 7.5. Typically, the pH of that formulation will not exceed about 9, and often will not exceed about 8.5. A representative tobacco formulation exhibits a pH of about 6.8 to about 8.2 (e.g., about 7.8). A representative technique for determining the pH of a tobacco formulation involves dispersing 5 g of that formulation in 100 ml of high performance liquid chromatography water, and measuring the pH of the resulting suspension/solution (e.g., with a pH meter). The presence of, particularly, a preservative, has been found according to the present disclosure to maintain a desirable pH level over a storage period. In some embodiments, the moist smokeless tobacco product is characterized, after a storage period of at least about 10 days, by a pH between about 7.5 and about 8.1. In some embodiments, the pH of the smokeless tobacco product is maintained between about 7.5 and about 8.1 for a storage period of at least about 10 days.

Storage and Storage Period

Products of the present invention may be packaged and stored in any suitable packaging in much the same manner that conventional types of smokeless tobacco products are packaged and stored. For example, a plurality of packets or pouches may be contained in a cylindrical container. See, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; D592,956 to Thiellier and D594,154 to Patel et al.; U.S. Pat. Pub. No. 2008/0173317 to Robinson et al.; U.S. Pat. Pub. No. 2009/0014343 to Clark et al.; U.S. Pat. Pub. No. 2009/0014450 to Bjorkholm; U.S. Pat. Pub. No. 2009/0250360 to Bellamah et al.; U.S. Pat. Pub. No. 2009/0266837 to Gelardi et al.; U.S. Pat. Pub. No. 2009/0223989 to Gelardi; U.S. Pat. Pub. No. 2009/0230003 to Thiellier; U.S. Pat. Pub. No. 2010/0084424 to Gelardi; and U.S. Pat. Pub. No. 2010/0133140 to Bailey et al; and U.S. patent application Ser. No. 29/342,212, filed Aug. 20, 2009, to Bailey et al.; U.S. patent application Ser. No. 12/425,180, filed Apr. 16, 2009, to Bailey et al.; U.S. patent application Ser. No. 12/685,819, filed Jan. 12, 2010, to Bailey et al.; and U.S. patent application Ser. No. 12/814,015, filed Jun. 11, 2010, to Gelardi et al., which are incorporated herein by reference.

If desired, moist tobacco products (e.g., products having moisture contents of more than about 20 weight percent) may be refrigerated (e.g., at a temperature of less than about 10° C., often less than about 8° C., and sometimes less than about 5° C.).

The storage period of the moist smokeless tobacco product as disclosed herein may vary. In some embodiments, the storage period is from about 10 days to about 150 days. In some embodiments, the storage period is about 10 days, about 20 days, about 30 days, about 40 days, about 60 days, about 80 days, about 100 days, about 120 days, about 140 days, or about 150 days. Any number of days between 10 and 150 are contemplated herein.

Configured for Oral Use

Provided herein is a moist smokeless tobacco product configured for oral use, the moist smokeless tobacco product comprising a tobacco material, one or more antioxidants, and one or more preservatives, each as described herein. The term "configured for oral use" as used herein means that the moist smokeless tobacco product is provided in a form (e.g., a water-permeable pouch or loose fibers) such that during use, saliva in the mouth of the user causes some of the components of the tobacco formulation to pass through e.g., the water-permeable pouch and into the mouth of the user.

Such moist smokeless tobacco products in the water-permeable pouch format are typically used by placing one pouch containing the tobacco formulation in the mouth of a human subject/user. The pouch preferably is not chewed or swallowed. The user is provided with tobacco flavor and satisfaction, and is not required to spit out any portion of the tobacco formulation. After about 10 minutes to about 60 minutes, typically about 15 minutes to about 45 minutes, of use/enjoyment, substantial amounts of the tobacco formulation and the contents of the optional microcapsules and have been ingested by the human subject, and the pouch may be removed from the mouth of the human subject for disposal.

Accordingly, in certain embodiments, the tobacco formulation as disclosed herein and any other components noted above are combined within a moisture-permeable packet or pouch that acts as a container for use of the tobacco to provide a moist smokeless tobacco product configured for oral use. Certain embodiments of the invention will be described with reference to FIG. 1 of the accompanying drawings, and these described embodiments involve snus-type products having an outer pouch and containing a treated tobacco material as described herein within the tobacco formulation. As explained in greater detail below, such embodiments are provided by way of example only, and the smokeless tobacco products of the present disclosure can include tobacco compositions in other forms. The composition/construction of such packets or pouches, such as the container pouch 102 in the embodiment illustrated in FIG. 1, may be varied. Referring to FIG. 1, there is shown a first embodiment of a moist smokeless tobacco product 100. The tobacco product 100 includes a moisture-permeable container in the form of a pouch 102, which contains a solid tobacco filler material 104 comprising a moist smokeless tobacco composition as described herein.

Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. The tobacco formulation may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user. Descriptions of various components of snus types of products and components thereof also are set forth in US Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and US Pat. Pub. No. 2005/0061339 to Hansson et al.; each of which is incorporated herein by reference. See, also, the types of pouches set forth in U.S. Pat. No. 5,167,244 to Kjerstad, which is incorporated herein by reference. Snus types of products can be manufactured using equipment such as that available as SB 51-1/T, SBL 50 and SB 53-2/T from Merz Verpackungmaschinen GmBH. Snus pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

An example pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other examples of pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

The amount of material contained within each pouch may vary. In smaller embodiments, the dry weight of the material within each pouch is at least about 50 mg to about 150 mg. For a larger embodiment, the dry weight of the material within each pouch preferably does not exceed about 300 mg to about 700 mg. In some embodiments, each pouch/container may have disposed therein a flavor agent member, as described in greater detail in U.S. Pat. No. 7,861,728 to Holton, Jr. et al., which is incorporated herein by reference. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

The moist smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 8,397,945 to Gelardi et al., D592,956 to Thiellier; D594,154 to Patel et al.; and D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; and 2011/0168712 to Bailey et al. which are incorporated herein by reference.

In some embodiments, the moist smokeless tobacco product is in the form of moist snuff. Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

EXAMPLES

Aspects of the present invention are more fully illustrated by the following examples, which are set forth to illustrate certain aspects of the present invention and are not to be construed as limiting thereof.

Stabilized Moist Smokeless Tobacco Formulations

Four moist smokeless tobacco formulations were prepared to evaluate stability of formulations with and without a preservative and an antioxidant. These formulations were as follows:

1. A control formulation without any stabilizers;
2. A formulation with 300 ppm of added TBHQ;
3. A formulation with 1000 ppm of added propylparaben; and
4. A formulation with both 1000 ppm propylparaben and 300 ppm TBHQ.

For each of the formulations, fine cut tobacco and the appropriate stabilizer were added to a blender, the mixture was agitated to achieve a uniformly mixed product, and the completed blend was discharged into tubs to await packaging in finished product cans for evaluation under storage.

Evaluation of Stability of Moist Smokeless Tobacco Products

Each of the four tobacco formulations were stored for various periods of time, and samples withdrawn for analysis of a number of parameters indicative of storage stability. The parameters chosen to determine stability of the product during storage were pH, percent moisture, nitrite, tobacco specific nitrosamine (TSNA), and percent organic acids (malate, acetate, citrate and lactate). Methods utilized are indicated below.

Procedure for Determination of pH

A sample of the tobacco material (5.0±0.1 grams) was placed in a specimen container. Deionized water (50±1 mL) was added and the mixture stirred with a magnetic stir bar for 15 minutes. The pH was measured on an Orion Model 3 Combination Electrode and Meter.

Procedure for Determination of % Moisture

Determination of % moisture was performed using the oven drying method, subtracting the end weight after drying for a predetermined time from the initial weight. The instrument used was a Brabender Moisture Tester MT-C model #890614. Sample weight was approximately 10 grams.

Procedure for Determination of Nitrite

A sample of the tobacco material (1.0000±0.1000 g) was placed into an empty 50 mL polypropylene conical tube and 25 ml water was added. The tube was capped and shaken on a platform shaker for 30±5 minutes. After the extraction was completed, the tube was centrifuged at 3000 rpm for 15 minutes, then filtered through a Whatman 0.45 μm autovial filter into a 15 mL disposable centrifuge tube.

A Strata-X 33u Polymeric Reversed Phase 500 mg/6 mL filter cartridge was conditioned by pipetting in 5 mL of Methanol and allowing it to stand for 5 minutes. After 5 minutes, vacuum was applied to draw through the remaining methanol. The cartridge was equilibrated by pipetting in 5 mL of deionized (DI) $H_2O$ and allowing it to stand for 10 minutes. After 10 minutes, vacuum was applied to draw through the remaining DI $H_2O$. The above filtered tobacco extract sample (1-2 mL) was added to the cartridge and allowed to stand for 5 minutes. After 5 minutes, vacuum was applied to draw through the remaining filtrate, which was discarded. The above filtered tobacco extract (5-6 mL) was then applied to the cartridge and the filtrate collected, capped, and stored in the dark until testing.

The nitrite content in the filtrate sample was determined by diazotization of sulfanilamide and coupling with N-(1-naphthyl)-ethylenediamine dihydrochloride under acidic conditions to form a reddish/pink azo-dye. The absorbance was measured at 540 nm and the nitrite concentration calculated by means of a calibration curve based on standards concentrations of 0.02, 0.05, 0.1, 0.2, 0.2875, 0.4, 0.5, 0.6667, 1.0 and 2.0 ppm. Analysis was performed on an automated Thermo Fisher Gallery Plus Discrete Analyzer for Photometric Analysis of Nitrite.

Nitrite (ppm) was calculated according to: Average Result (mg/1)×(Water weight (g))/(Sample weight (g)).

Procedure for Determination of TSNAs

TSNA content was determined by Liquid Chromatography/Triple Quadrupole Mass Spectrometer (LC/MS/MS) under positive ionization. Standards used were NNN, NNK, NAT, and NAB, prepared from 1 mg/ml stock concentration by dilution to provide a range of concentrations from 0 to 400 ng/ml.

Tobacco samples were weighed into a 40 ml amber borosilicate vial and 30 mL of 100 mM ammonium acetate containing deuterated TSNA internal standards was added. The samples were shaken for 30 minutes on an orbital shaker. Approximately 3 ml of sample was decanted into a 0.45 μm PVDF Filter Syringe. The first 1 ml of filtrate was discarded, and about 2 mL of filtrate was collect in an amber HPLC vial. Samples were injected and analyzed by LC using the parameters indicated below.

Agilent HPLC Parameters:
Mobile Phase A—95% 10 mM Ammonium Acetate pH 6.75: 5% ACN
Mobile Phase B—0.1% Acetic Acid in ACN
Gradient elution: 0 to 50% B over 4 minutes
Flow rate: 0.6 ml/min
Column Temperature: 70° C.
Total Time: 8 minutes
Column: Phenomenex Gemini 3 um C18 110 Å 150×2 mm
Injection Volume: 2 μL-5 μL
Autosampler Temperature: 4° C.
ABSciex 5500 Source and Detector Parameters:
Curtain Gas (CUR): 40
Collision Gas (CAD): 3
Ion Spray Voltage (IS): 2500
Temperature (TEM): 500
Nebulizer Gas (GS1): 60
Auxiliary Gas (GS2): 60
Vertical Position: 0

MultiQuant Method Parameters are provided in Table 1.

TABLE 1

Method Parameters
Quantitation Method

| | NNK | d4-NNK | NNN | d4-NNN | NAT | d4-NAT | NAB | d4-NAB |
|---|---|---|---|---|---|---|---|---|
| Gaussian Smooth Width (points) | 2.0 | 2.0 | 1.5 | 1.5 | 1.5 | 1.5 | 1.5 | 1.5 |
| Expected RT (min) | 4.71 | 4.70 | 4.41 | 4.39 | 5.07 | 5.06 | 5.20 | 5.19 |
| RT Half Window (sec) | 30.0 | 30.0 | 30.0 | 30.0 | 30.0 | 30.0 | 30.0 | 30.0 |
| Update Expected RT | No | No | No | No | No | No | No | No |
| Min. Peak Width (points) | 3 | 3 | 3 | 3 | 3 | 3 | 3 | 3 |
| Min. Peak Height | 0.00 | 0.00 | 0.00 | 0.00 | 0.00 | 0.00 | 0.00 | 0.00 |
| Noise Percentage (%) | 100.0 | 100.0 | 100.0 | 100.0 | 100.0 | 100.0 | 100.0 | 100.0 |
| Baseline Sub. Window (min) | 2.00 | 2.00 | 2.00 | 2.00 | 2.00 | 2.00 | 2.00 | 2.00 |
| Peak Splitting (points) | 5 | 5 | 5 | 5 | 5 | 5 | 5 | 5 |

Procedure for Determination of Organic Acids

Organic acid content (acetic, citric, malic, and lactic) were determined by colorimetric and enzymatic reactions on an automated ThermoFisher Gallery Plus Discrete Analyzer for Photometric organic acid analysis.

Principles of Method

Acetic acid quantitation is based on the reaction of acetate kinase (AK) in the presence of ATP to convert acetic acid (acetate) into acetyl-phosphate and adenosine-5'-diphosphate (ADP). This reaction is significantly accelerated by the rapid conversion of the acetyl-phosphate product into acetyl-CoA and inorganic phosphate, by the action of phosphotransacetylase (PTA) in the presence of coenzyme A (CoA). The ADP formed is reconverted into ATP and pyruvate, by phosphoenolpyruvate (PEP) in the presence of ADP-dependent hexokinase (ADP-HK). In the presence of the enzyme Glucose-6-phosphate dehydrogenase (G6P-DH), D-Glucose-6-phosphate is reduced to D-Glucono-o-lactone-6-phosphate by reduced Nicotinamide-adenine dinucleotide (NADH) with the production of $NAD^+$. The amount of NADH formed in the above reaction pathway is stoichiometric with the amount of acetate. It is NADH consumption which is measured by the decrease in absorbance at 340 nm. The method was performed at 37° C. The acetic acid concentration was calculated by means of a calibration curve.

Citric acid quantitation is based on the reaction of oxaloacetate and acetate catalyzed by the enzyme citric lyase (CL). In the presence of the enzymes L-malate dehydrogenase (L-MDL) and L-lactate dehydrogenase (L-LDH), oxaloacetate and its decarboxylation product pyruvate are reduced to L-malate and L-lactate, respectively, by reduced nicotinamide-adenine dinucleotide (NADH). The amount of NADH oxidized in reactions is stoichiometric to the amount of citrate. The method was performed at 37° C. and NADH was determined by absorbance at 340 nm. The citric acid concentration was calculated by means of a calibration curve.

L-Lactic Acid quantitation is based on the reaction of L-Malic Acid (malate) to oxaloacetate in the reaction catalyzed by the enzyme L-malate dehydrogenase (L-MDL). In the presence of the enzyme Glutamate-Oxaloacetate-Transaminase (GOT), Oxaloacetate and L-Glutamate are reduced to L-Aspartame and 2-Oxoglutarate, respectively. The amount of NADH oxidized in the reactions is stoichiometric to the amount of malate. The method was performed at 37° C. and NADH was determined by absorbance at 340 nm. The malic acid concentration was calculated by means of a calibration curve.

Sample Preparation

A sample of the tobacco material (1.0000±0.1000 g) was weighed into an empty 50 mL polypropylene conical tube and 25.0 mL of water was added. The mixture was shaken on a platform shaker for 30±5 minutes. After the extraction was completed, the tube was centrifuged at 3000 rpm for 5 minutes, then filtered through a 0.45 μm filter into a 15 mL disposable centrifuge tube.

A Strata-X 33u Polymeric Reversed Phase 500 mg/6 mL filter cartridge was conditioned by pipetting in 5 mL of Methanol and allowing it to stand for 5 minutes. After 5 minutes, vacuum was applied to draw through the remaining methanol. The cartridge was equilibrated by pipetting in 5 mL of deionized (DI) $H_2O$ and allowing it to stand for 10 minutes. After 10 minutes, vacuum was applied to draw through the remaining DI $H_2O$. The above filtered tobacco extract sample (1-2 mL) was added to the cartridge and allowed to stand for 5 minutes. After 5 minutes, vacuum was applied to draw through the remaining filtrate, which was discarded. The above filtered tobacco extract (5-6 mL) was then applied to the cartridge and the filtrate collected, capped, and stored in the dark until testing.

Samples were analyzed on a ThermoFisher Gallery Plus Discrete Analyzer and organic acid concentrations calculated from calibration curves and calculated according to the equation:

$$\text{Organic Acid(ppm)}=\text{Average Result(g/L)}\times(\text{Water weight(g)})/(\text{Sample weight(g)})\times 1000.$$

Results

Generally, when the moist smokeless tobacco formulation included both propylparaben and TBHQ, the product was more stable during storage, i.e., there was no major increase in parameters measured throughout the storage of the product, or there was desirable decrease in parameters measured during storage of the product, and a desirable relationship developed between organic acids throughout the storage of the product.

Figure 2:
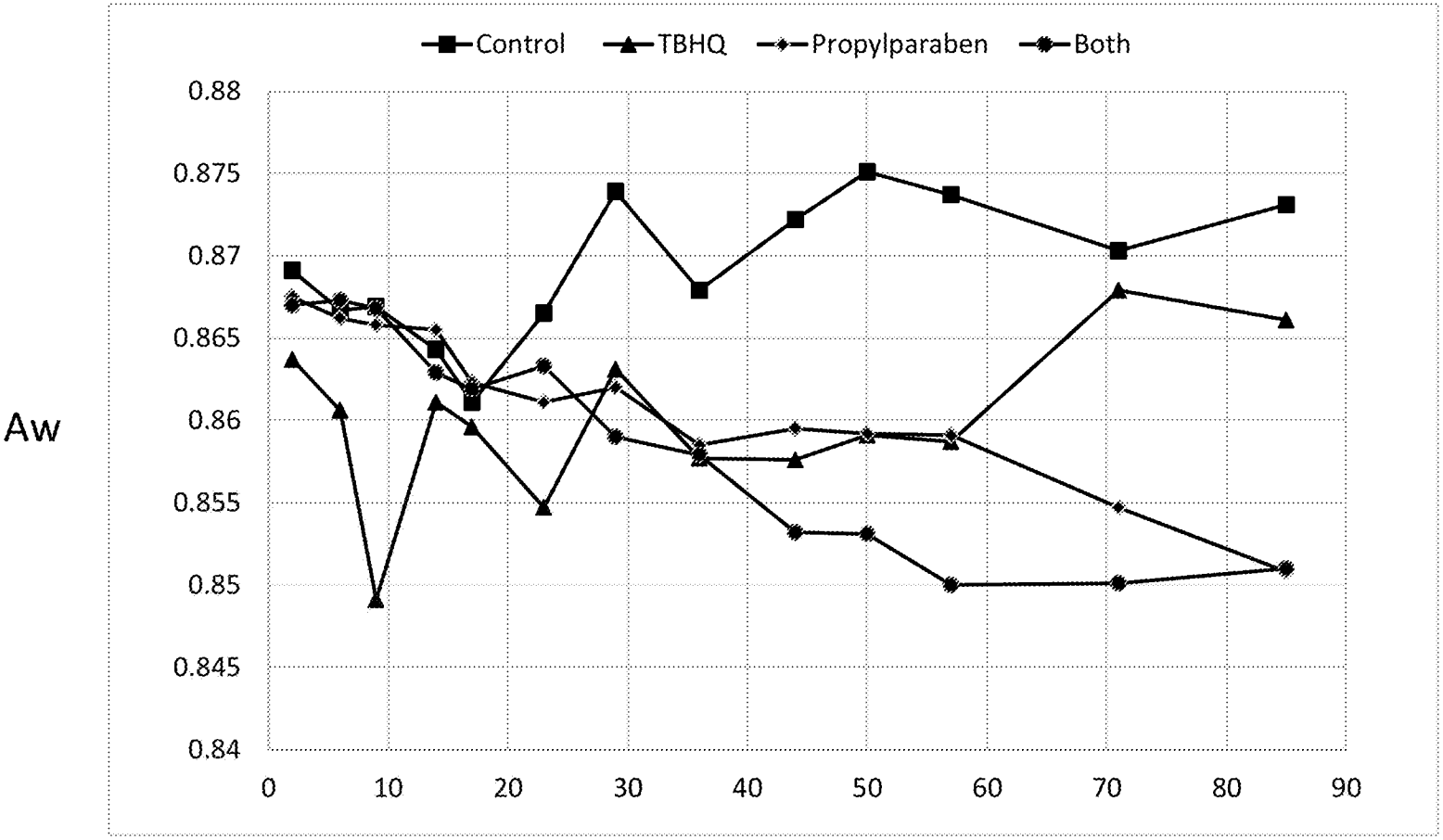
FIG. 2 is a line graph illustrating the moisture content over a storage period for certain embodiments of smokeless tobacco compositions of the disclosure relative to a control smokeless tobacco composition which has not been stabilized.

The moisture content for each of the four moist smokeless tobacco formulations over a storage period, measured as Aw, is provided in FIG. 2. The data indicate that the combination of both propylparaben and TBHQ was best for maintaining and/or avoiding an increase in Aw value.

Figure 3:
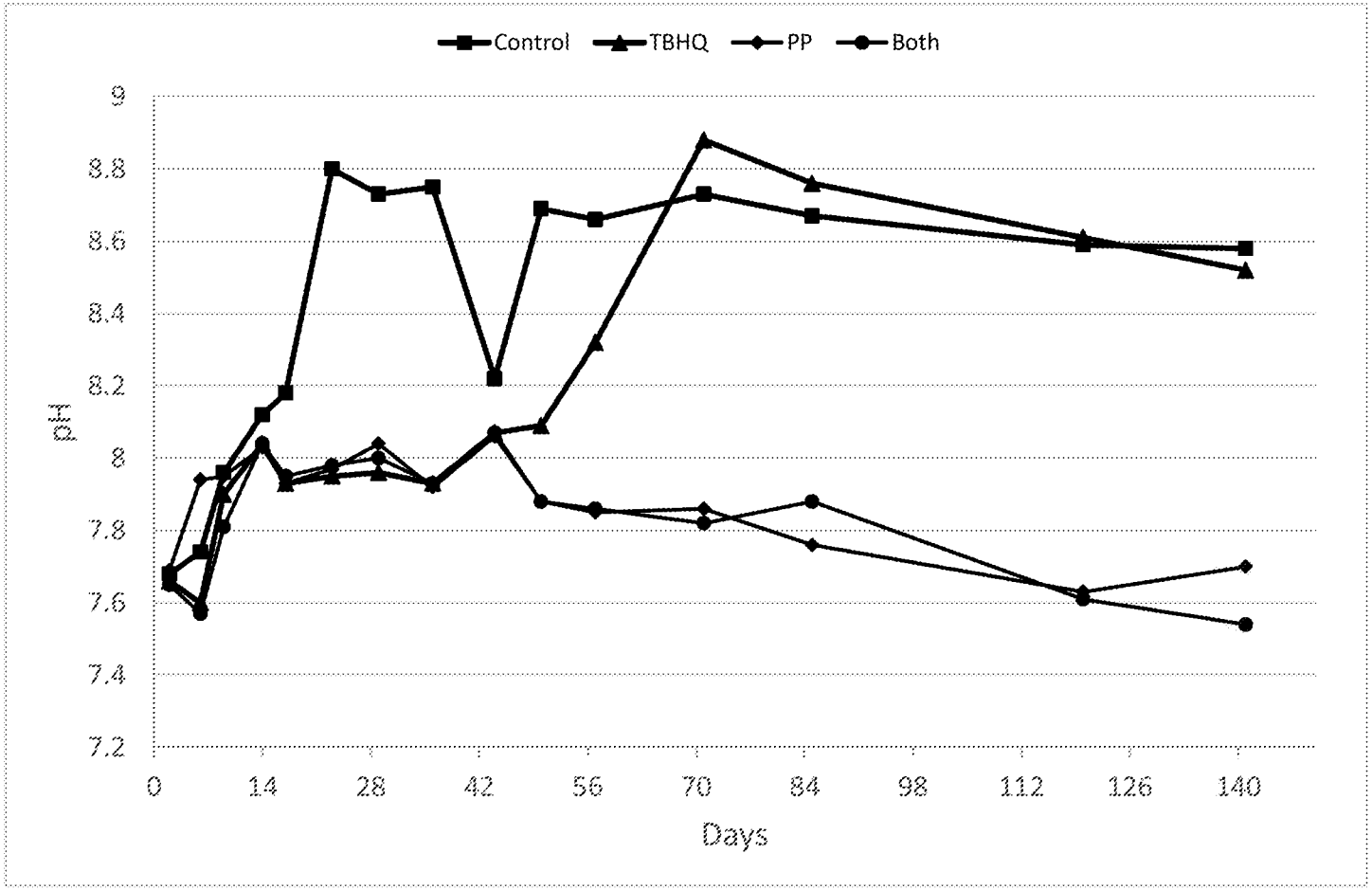
FIG. 3 is a line graph illustrating the pH for certain embodiments of smokeless tobacco compositions of the disclosure over a storage period, relative to a control smokeless tobacco composition which has not been stabilized.

The pH values for each of the four moist smokeless tobacco formulations over a storage period are provided in FIG. 3. The data indicate that propylparaben maintains pH stability.

Figure 4:
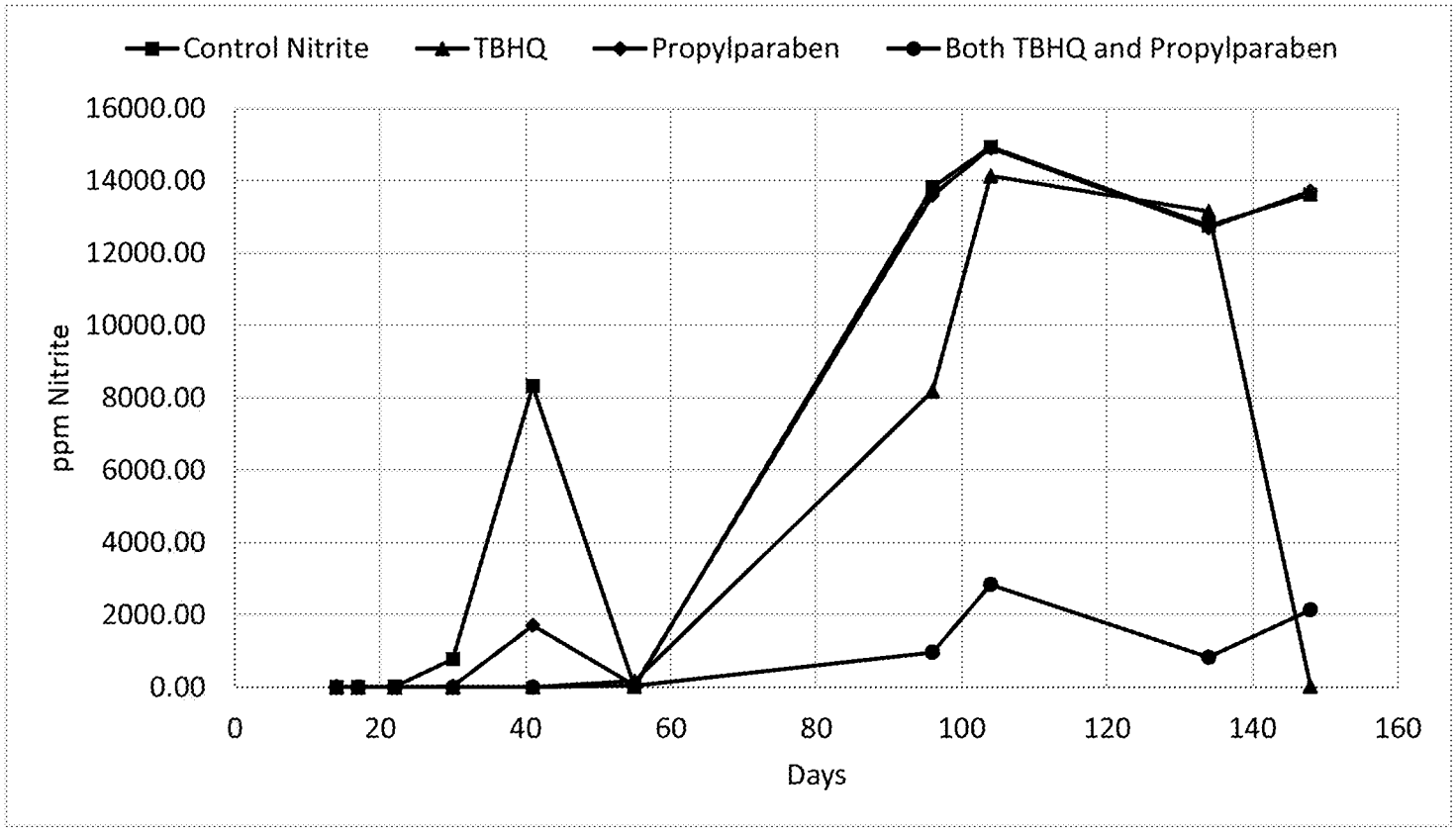
FIG. 4 is a line graph illustrating the nitrite content for certain embodiments of smokeless tobacco compositions of the disclosure over a storage period, relative to a control smokeless tobacco composition which has not been stabilized.
Figure 5:
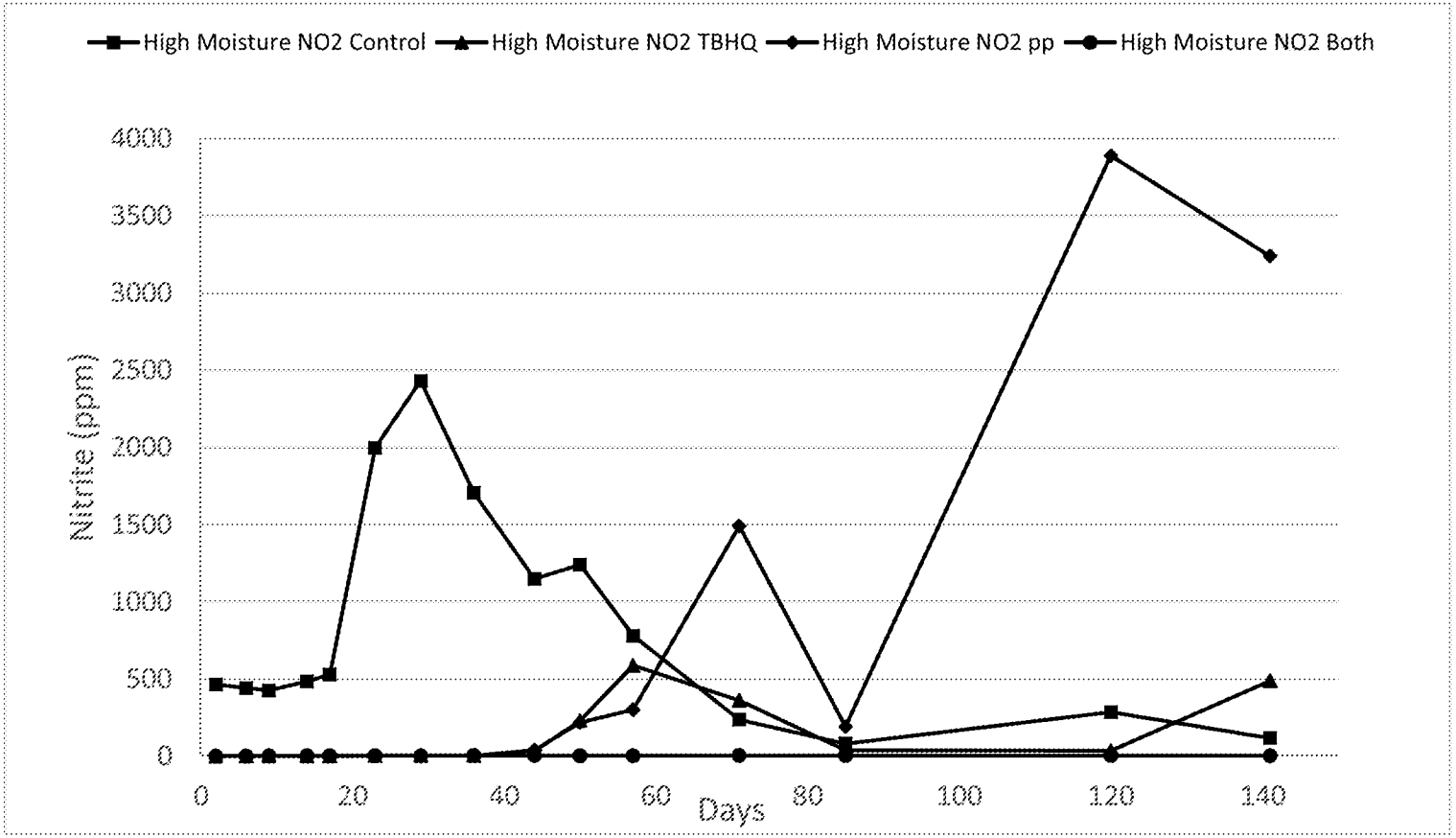
FIG. 5 is another line graph illustrating the nitrite content for certain embodiments of smokeless tobacco compositions of the disclosure over a storage period, relative to a control smokeless tobacco composition which has not been stabilized.

The nitrite content for each of the four moist smokeless tobacco formulations over a storage period is provided in FIGS. 4 and 5 (obtained in two separate studies). The data in FIG. 5 indicate that TBHQ affects nitrate-to-nitrite reduction better then propylparaben, but both together are best. The data in FIG. 4 more clearly demonstrate the superiority of both together for avoidance of increased nitrite formation over the storage period.

Figure 6:
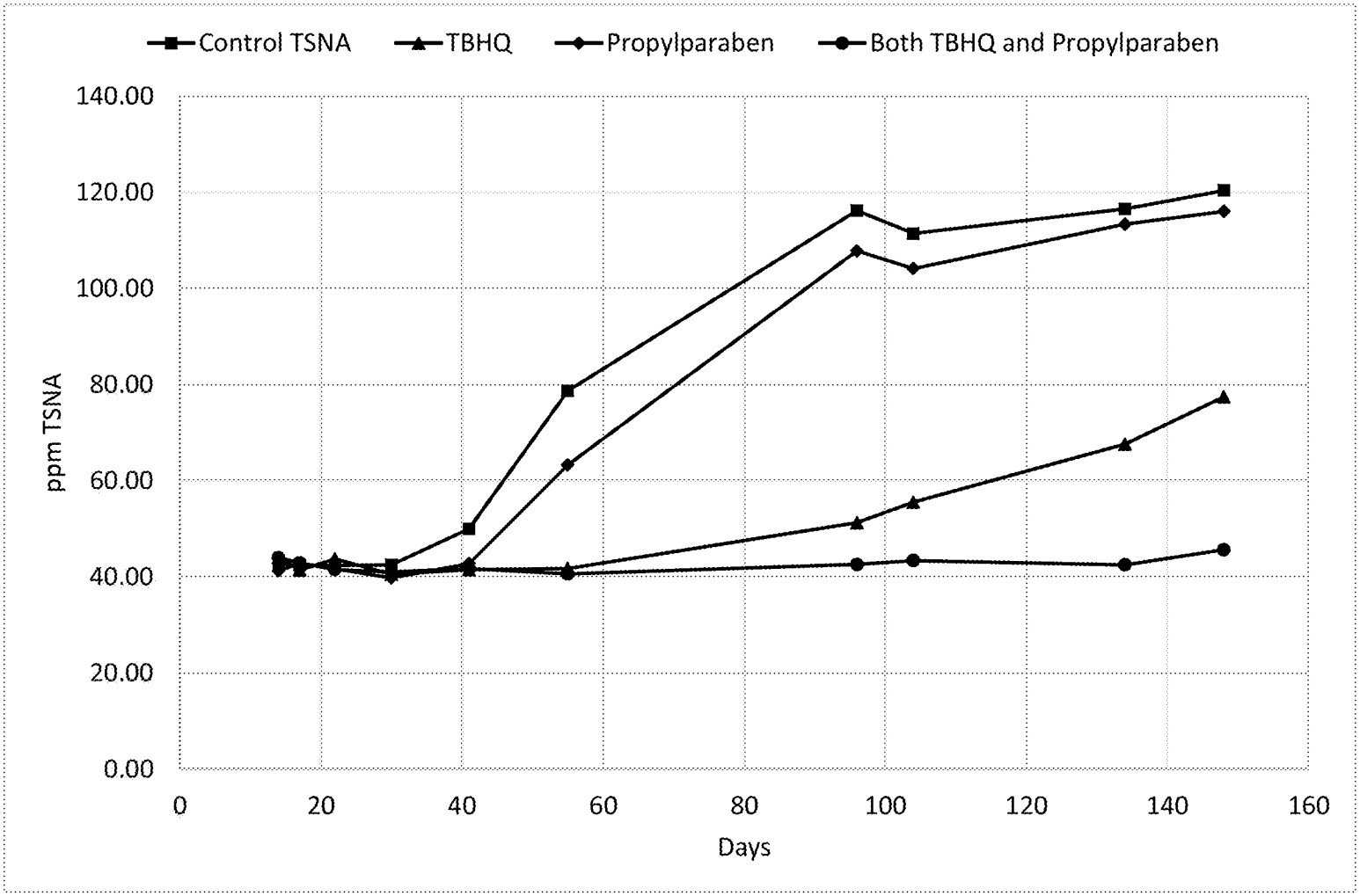
FIG. 6 is a line graph illustrating the tobacco-specific nitrosamine (TSNA) content for certain embodiments of smokeless tobacco compositions of the disclosure over a storage period, relative to a control smokeless tobacco composition which has not been stabilized.
Figure 7:
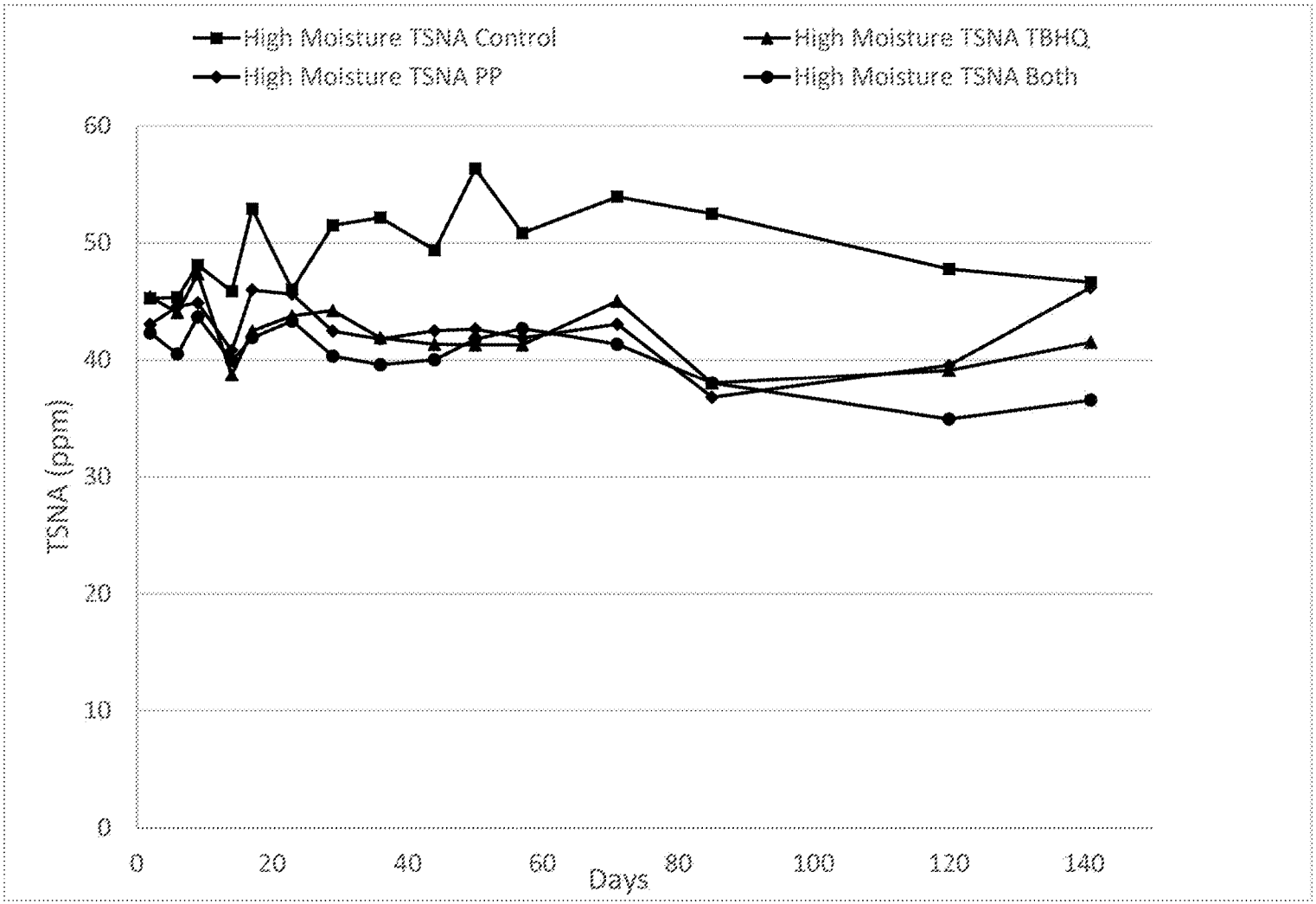
FIG. 7 is another line graph illustrating the tobacco-specific nitrosamine (TSNA) content for certain embodiments of smokeless tobacco compositions of the disclosure over a storage period, relative to a control smokeless tobacco composition which has not been stabilized.

The tobacco-specific nitrosamine (TSNA) content for each of the four moist smokeless tobacco formulations over a storage period is provided in FIGS. 6 and 7 (obtained in two separate studies). The data in FIG. 6 indicate that propylparaben alone had little effect on TSNA formation, and the combination of propylparaben and TBHQ was far superior for avoiding an increase in TSNA concentration. The results shown in FIG. 7 were smaller in magnitude, but still support the advantage of the combination of propylparaben and TBHQ. The results for all TSNA formation studies were subjected to three statistical analyses (ANOVA, Regression, and paired t-test), which indicated the statistically significance of the treatment effect for the propylparaben/TBHQ combination.

Figure 8:
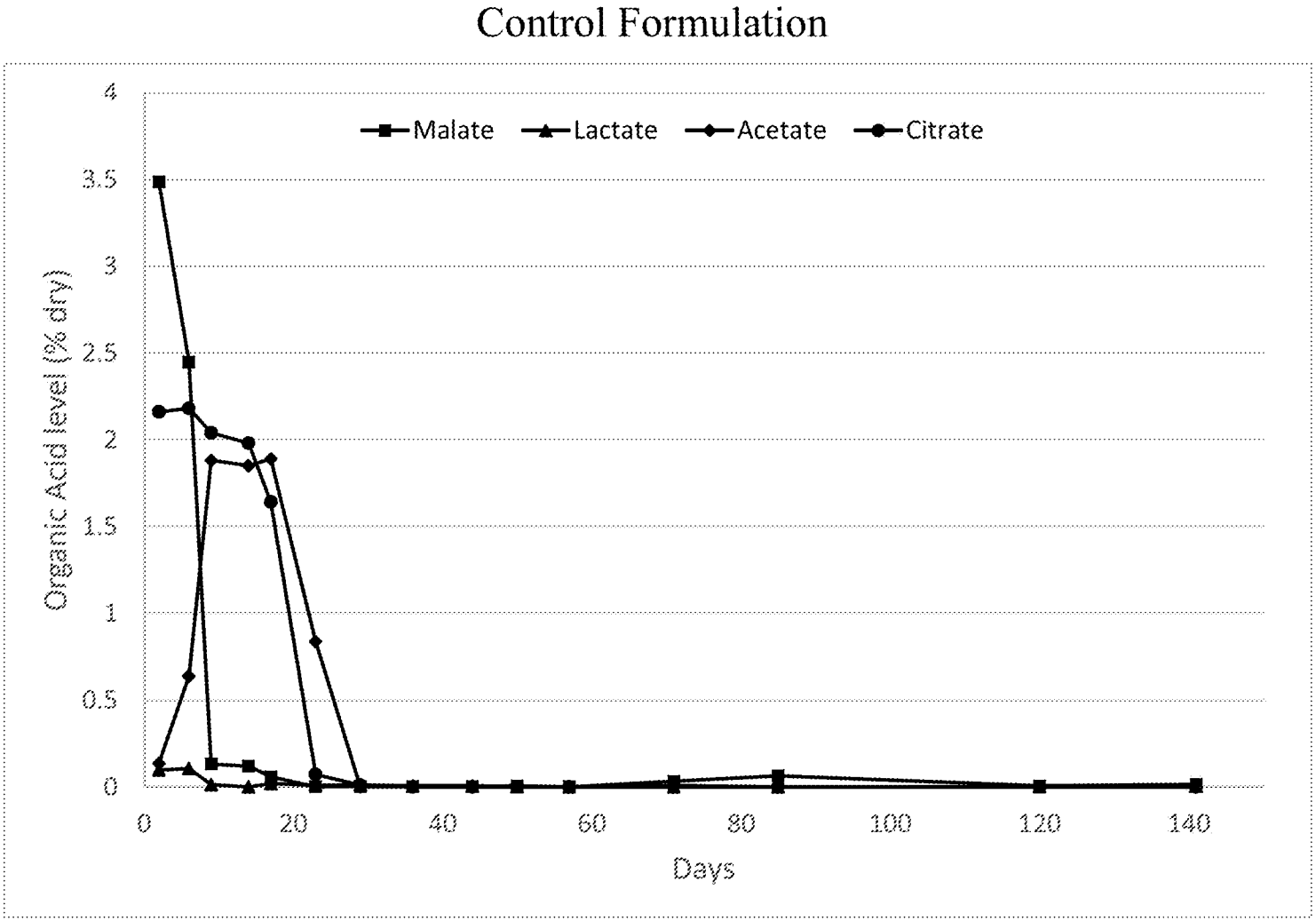
FIG. 8 is a line graph illustrating the level of various organic acids over a storage period for a control smokeless tobacco composition which has not been stabilized.
Figure 9:
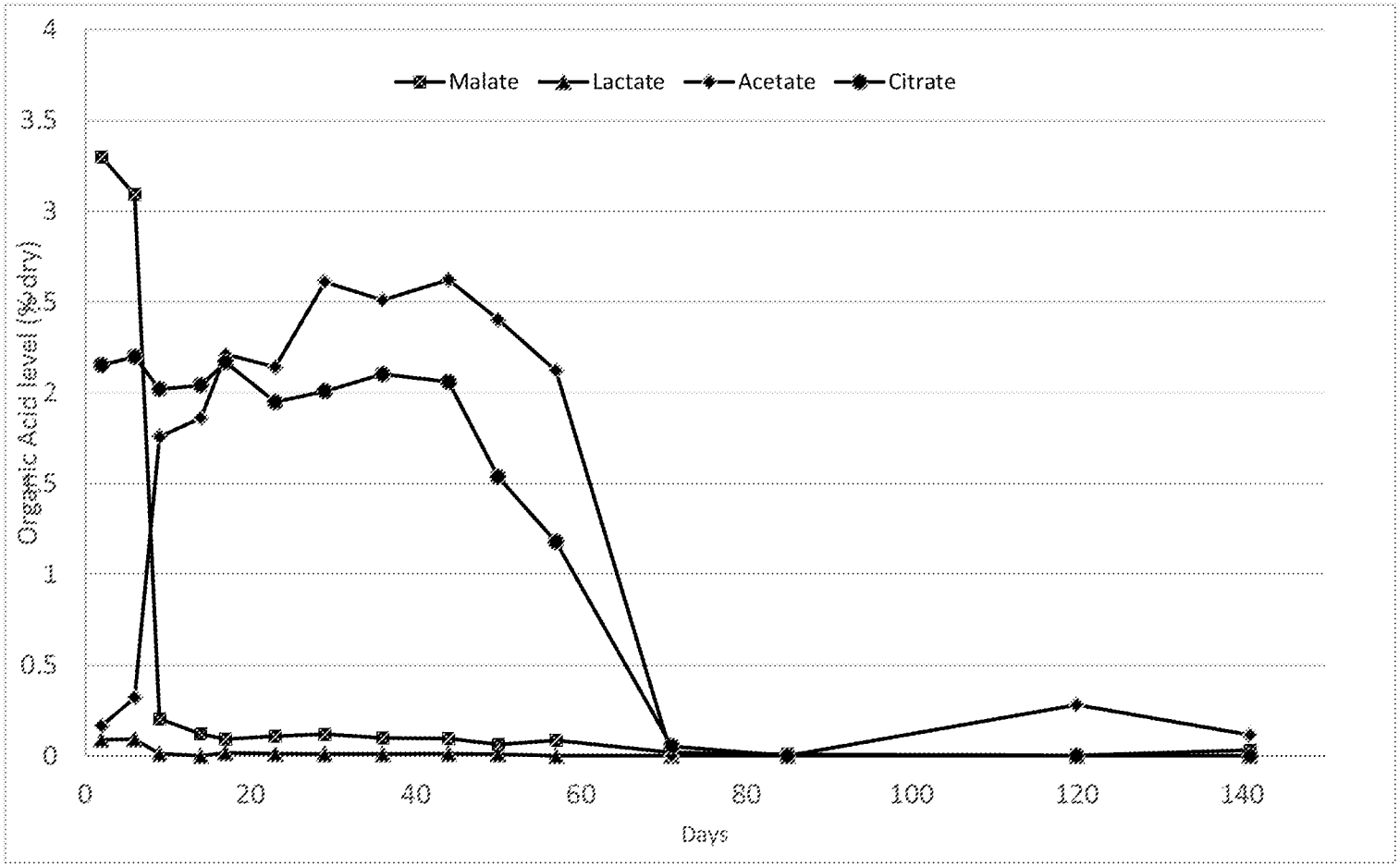
FIG. 9 is a line graph illustrating the level of various organic acids over a storage period for an embodiment of a smokeless tobacco composition of the disclosure.
Figure 10:
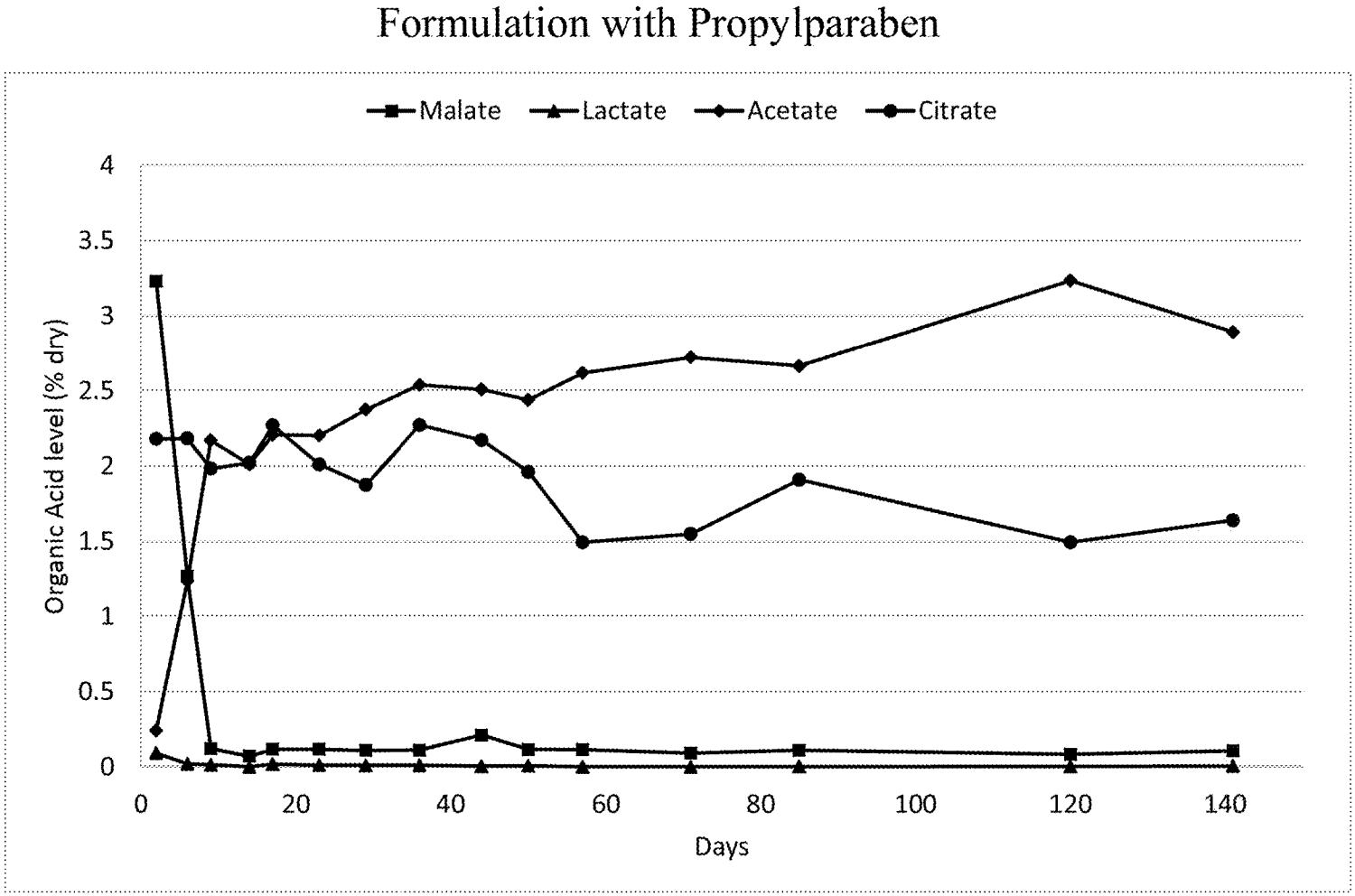
FIG. 10 is a line graph illustrating the level of various organic acids over a storage period for another embodiment of a smokeless tobacco composition of the disclosure.
Figure 11:
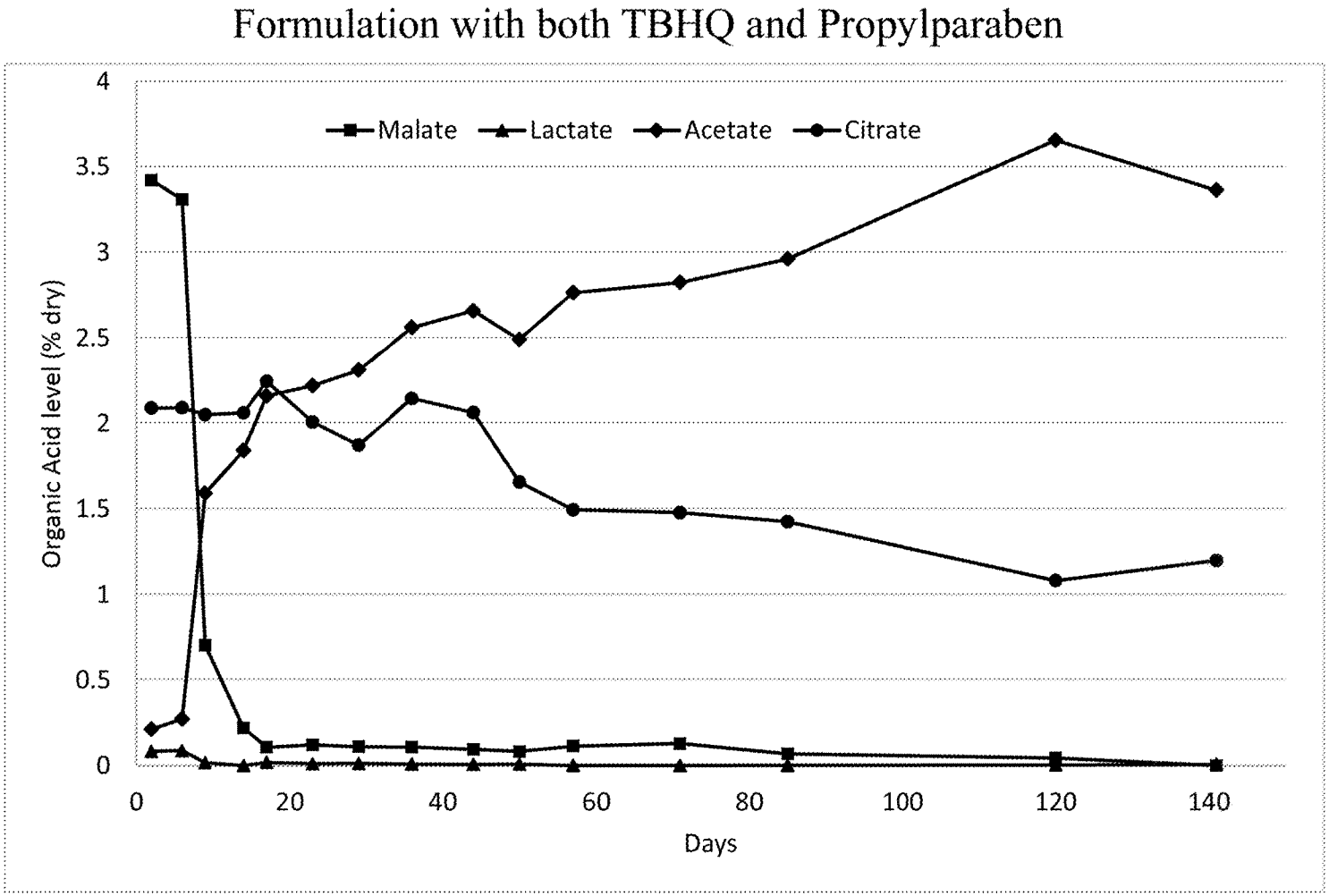
FIG. 11 is a line graph illustrating the level of various organic acids over a storage period for yet another embodiment of a smokeless tobacco composition of the disclosure.

The level of various organic acids (malate, lactate, acetate, and citrate) for the control moist smokeless tobacco formulation over a storage period is provided in FIG. 8. The level of the same organic acids for the moist smokeless tobacco formulations containing TBHQ, propylparaben, and both TBHQ and propylparaben over a storage period are provided in FIGS. 9-11, respectively. The data indicate that propylparaben most effectively maintains desirable acetate and citrate concentrations.

Figure 12:
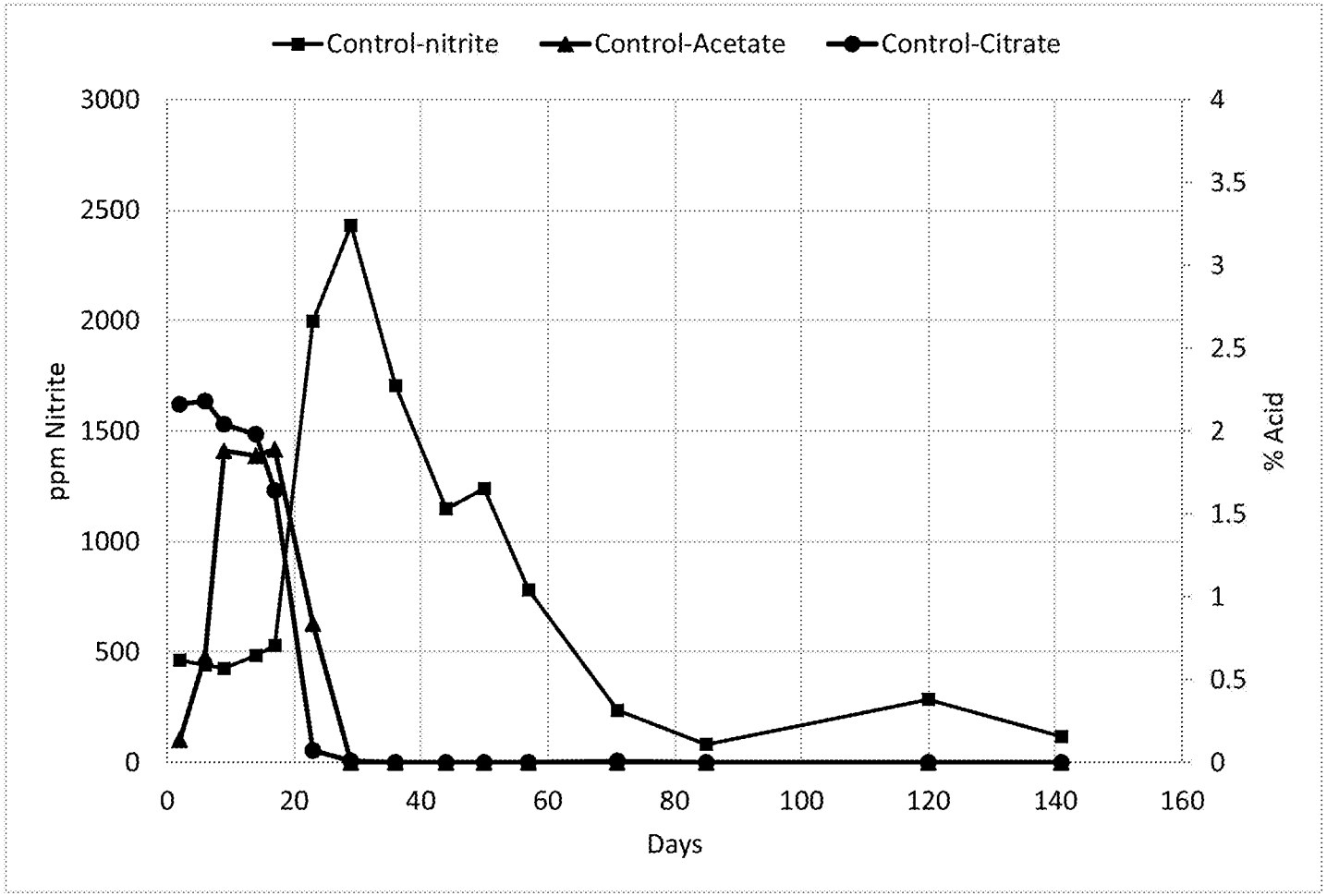
FIG. 12 is a line graph illustrating the level of nitrite, acetate and citrate over a storage period for a control smokeless tobacco composition which has not been stabilized.
Figure 13:
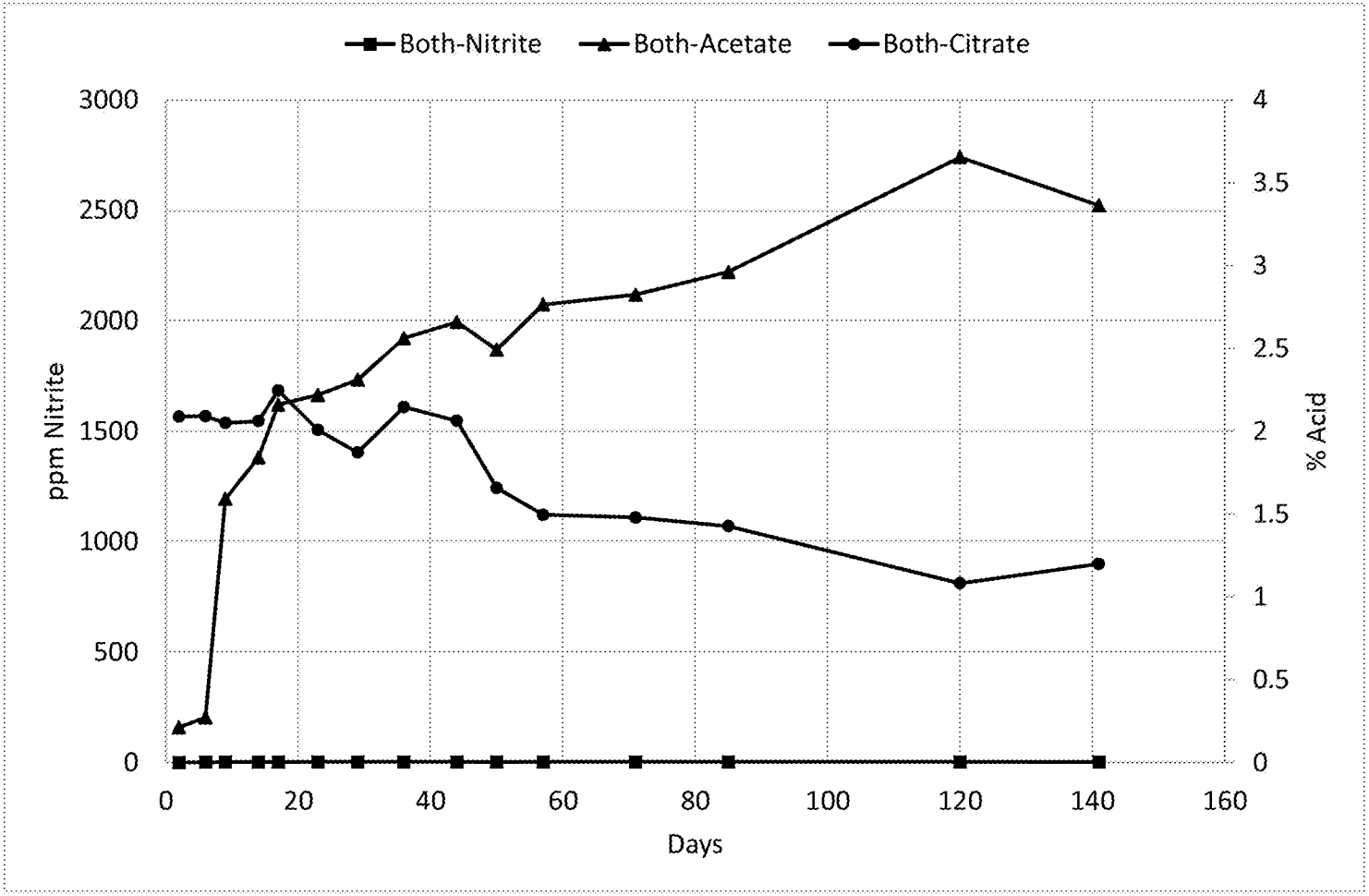
FIG. 13 is a line graph illustrating the level of nitrite, acetate and citrate over a storage period for an embodiment of a smokeless tobacco composition of the disclosure.

The level of nitrite, acetate, and citrate for the control moist smokeless tobacco formulation and the moist smokeless tobacco formulation containing both TBHQ and propylparaben over a storage period is provided in FIGS. 12 and 13, respectively. The data indicate that the combination of propylparaben and TBHQ effectively maintains desirable acetate and citrate concentrations while avoiding a rise in nitrite level.

Figure 14:
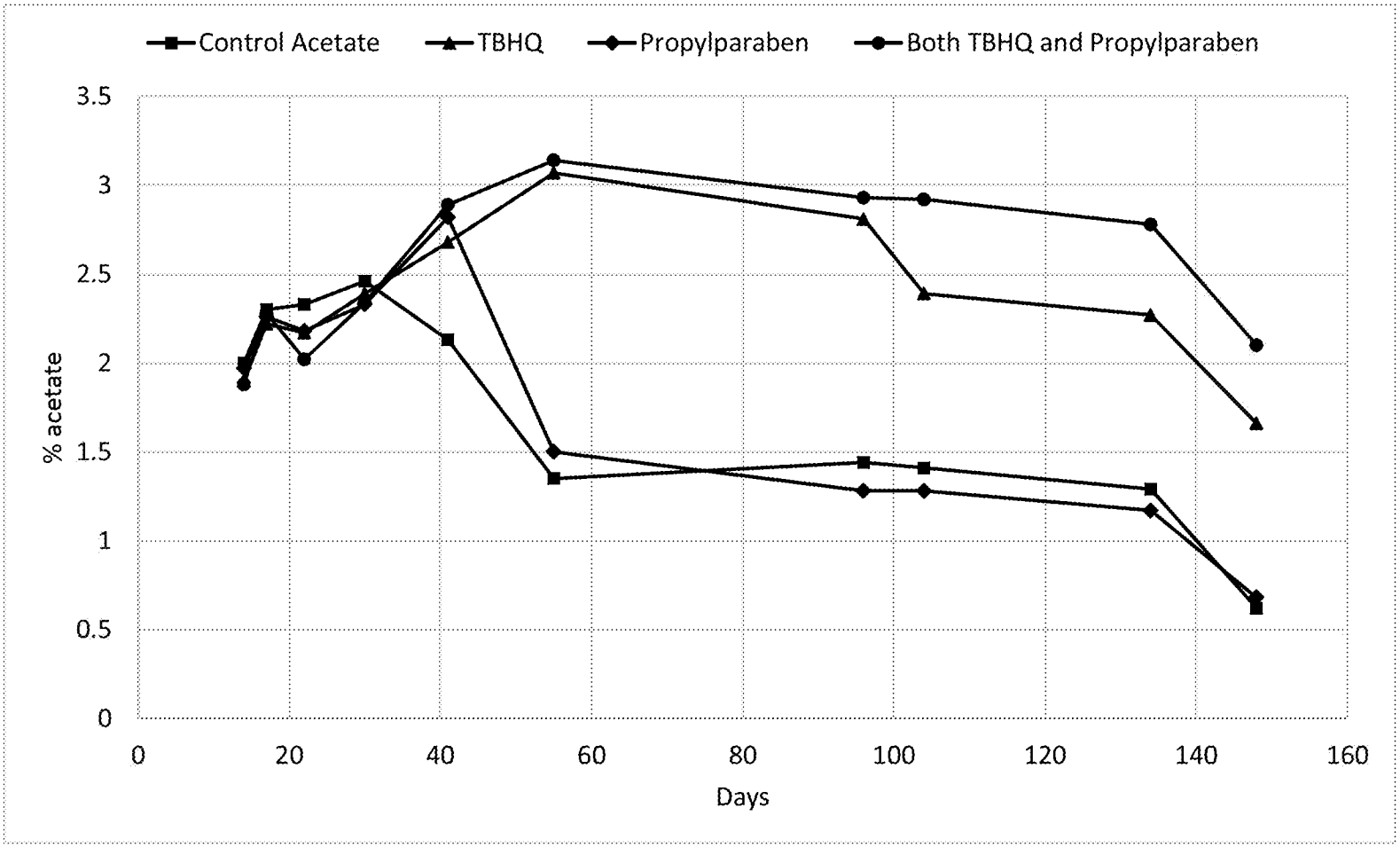
FIG. 14 is a line graph illustrating the acetate content for certain embodiments of smokeless tobacco compositions of the disclosure over a storage period, relative to a control smokeless tobacco composition which has not been stabilized.

The level of acetate for each of the four moist smokeless tobacco formulations over a storage period is provided in FIG. 14. The data indicate that propylparaben alone, similar to control, did not maintain acetate levels over the storage period. In contrast, TBHQ, and preferably a combination of TBHQ and propylparaben, provided a favorable acetate profile.

In general, the trends in data in FIGS. 2-14 can be summarized as follows:

Storage of the control smokeless tobacco formulation (absence of TBHQ and propylparaben) resulted in undesirable increases in pH, Aw, moisture, nitrite, TSNAs, and unwanted depletion of in acetate and citrate, which are indicative of poor product stability.

Addition of TBHQ and propylparaben individually, provided a product with better stability relative to the control that had no additives. TBHQ and propylparaben, used together, provided a product with the best overall stability profile.

Finally, addition of TBHQ and propylparaben did not hinder the attainment of a desirable organic acid profile (e.g., a drop in malate concentration and an increase in acetate concentration, along with a slight drop in citrate concentration), which was indicative of a good product stability.

What is claimed is:

1. A method for improving the storage stability of a moist smokeless tobacco product configured for oral use, the moist smokeless tobacco product comprising a tobacco formulation comprising a tobacco material, the method comprising mixing the tobacco material with tertiary-butylhydroquinone (TBHQ), added in an amount to provide an initial concentration in the tobacco formulation of about 300 parts per million (ppm) by weight on a dry weight basis and propylparaben, added in an amount to provide an initial concentration in the tobacco formulation of about 1000 ppm by weight on a dry weight basis to form the tobacco formulation, wherein the tobacco formulation comprises a tobacco material having a moisture content from about 40% to about 70%.

2. The method of claim 1, wherein the moist smokeless tobacco product is in the form of moist snuff.

3. The method of claim 1, wherein the tobacco formulation comprises a tobacco material having a moisture content of from about 50% to about 60%.

4. The method of claim 1, wherein the tobacco formulation comprises a tobacco material having a water activity (Aw) of from about 0.85 to about 0.88.

5. The method of claim 1, further comprising adding one or more additional components to the tobacco formulation, the additional components selected from the group consisting of flavorants, fillers, binders, pH adjusters, buffering agents, colorants, disintegration aids, and humectants.

6. The method of claim 1, wherein a concentration of citrate in the tobacco formulation is maintained between about 1% and about 2% for a storage period of at least about 10 days at a temperature of less than about 10° C. in a closed container.

7. The method of claim 1, wherein a water activity (Aw) value is maintained between about 0.85 and about 0.88 for a storage period of at least about 10 days at a temperature of less than about 10° C. in a closed container.

8. The method of claim 1, wherein the pH of the smokeless tobacco product is maintained between about 7.5 and about 8.1 for a storage period of at least about 10 days at a temperature of less than about 10° C. in a closed container.

9. The method of claim 1, wherein a concentration of nitrite is maintained below about 10 ppm for a storage period of at least about 10 days at a temperature of less than about 10° C. in a closed container.

10. The method of claim 1, wherein a tobacco-specific nitrosamines (TSNA) concentration is maintained below about 50 ppm on a dry weight basis for a storage period of at least about 10 days at a temperature of less than about 10° C. in a closed container.

11. The method of claim 1, wherein a TSNA concentration of the tobacco formulation is reduced over a storage period of at least about 10 days, at a temperature of less than about 10° C. in a closed container, relative to a control tobacco formulation which does not contain TBHQ and propylparaben.

12. The method of claim 1, wherein a concentration of acetate is maintained between about 1% and about 4% over a storage period of at least about 10 days at a temperature of less than about 10° C. in a closed container.

13. A moist smokeless tobacco product configured for oral use, the moist smokeless tobacco product produced according to the method of claim 1.

14. A moist smokeless tobacco product configured for oral use, the moist smokeless tobacco product comprising a tobacco material, TBHQ in a concentration of about 300 ppm by weight in the moist smokeless tobacco product on a dry weight basis, and propylparaben in a concentration of about 1000 ppm by weight in the moist smokeless tobacco product on a dry weight basis, wherein the moist smokeless tobacco product has a moisture content from about 40% to about 70%.

15. The moist smokeless tobacco product of claim 14, wherein the moist smokeless tobacco product is in the form of moist snuff.

16. The moist smokeless tobacco product of claim 14, wherein the moist smokeless tobacco product has a moisture content of from about 50% to about 60%.

17. The moist smokeless tobacco product of claim 14, wherein the moist smokeless tobacco product has a water activity (Aw) of about 0.85 to about 0.88.

18. The moist smokeless tobacco product of claim 14, further comprising one or more additional components selected from the group consisting of flavorants, fillers, binders, pH adjusters, buffering agents, colorants, disintegration aids, and humectants.

19. The moist smokeless tobacco product of claim 14, wherein the moist smokeless tobacco product is characterized, after a storage period of at least about 10 days at a temperature of less than about 10° C. in a closed container, by a tobacco specific nitrosamine (TSNA) concentration that is reduced relative to a control moist smokeless tobacco product which does not comprise TBHQ and propylparaben.

20. The moist smokeless tobacco product of claim 14, wherein the moist smokeless tobacco product is characterized, after a storage period of at least about 10 days at a temperature of less than about 10° C. in a closed container, by a TSNA concentration below about 50 ppm on a dry weight basis.

21. The moist smokeless tobacco product of claim 14, wherein the moist smokeless tobacco product is characterized, after a storage period of at least about 10 days at a temperature of less than about 10° C. in a closed container, by a concentration of citrate between about 1% and about 2%.

22. The moist smokeless tobacco product of claim 14, wherein the moist smokeless tobacco product is characterized, after a storage period of at least about 10 days at a temperature of less than about 10° C. in a closed container, by an Aw value between about 0.85 and about 0.88.

23. The moist smokeless tobacco product of claim 14, wherein the moist smokeless tobacco product is characterized, after a storage period of at least about 10 days at a temperature of less than about 10° C. in a closed container, by a pH between about 7.5 and about 8.1.

24. The moist smokeless tobacco product of claim 14, wherein the moist smokeless tobacco product is characterized, after a storage period of at least about 10 days at a temperature of less than about 10° C. in a closed container, by a concentration of nitrite below about 10 ppm.

25. The moist smokeless tobacco product of claim 14, wherein the moist smokeless tobacco product is characterized, after a storage period of at least about 10 days at a temperature of less than about 10° C. in a closed container, by a concentration of acetate between about 1% and about 4%.

26. The moist smokeless tobacco product of claim 19, wherein the storage period is from about 10 days to about 150 days.

* * * * *